US007127188B2

(12) United States Patent
Akita et al.

(10) Patent No.: US 7,127,188 B2
(45) Date of Patent: Oct. 24, 2006

(54) IMAGE FORMING APPARATUS

(75) Inventors: Masanori Akita, Toride (JP); Kazuhiro Hasegawa, Toride (JP); Ikuo Nakamoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 196 days.

(21) Appl. No.: 11/007,160

(22) Filed: Dec. 9, 2004

(65) Prior Publication Data

US 2005/0135827 A1 Jun. 23, 2005

(30) Foreign Application Priority Data

Dec. 19, 2003 (JP) ..... 2003-422639
Oct. 20, 2004 (JP) ..... 2004-305129

(51) Int. Cl.
*G03G 15/20* (2006.01)

(52) U.S. Cl. ..... 399/67

(58) Field of Classification Search ..... 399/69, 399/67, 82

See application file for complete search history.

(56) References Cited

U.S. PATENT DOCUMENTS 4,928,148 A * 5/1990 Higashi
5,423,526 A 6/1995 Hasegawa ..... 271/10
5,512,993 A 4/1996 Endo et al. ..... 355/285
5,918,087 A 6/1999 Kimura et al. ..... 399/69
6,937,828 B1 8/2005 Hasegawa et al. ..... 399/69
2003/0228167 A1 12/2003 Hasegawa et al. ..... 399/69
2004/0005157 A1 1/2004 Akita ..... 399/45
2005/0135827 A1 6/2005 Akita et al. ..... 399/69

FOREIGN PATENT DOCUMENTS

JP 2-211471 8/1990
JP 10-39673 2/1998

* cited by examiner

*Primary Examiner*—Susan Lee
(74) *Attorney, Agent, or Firm*—Fitzpatrick, Cella, Harper & Scinto

(57) ABSTRACT

In an image forming apparatus having single-color mode and full-color mode, to maintain an excellent fusing property of the single-color image and the full-image even on the condition that the temperature of the fixing member is easy to fall, when the temperature of the fusing roller lowers during the image forming job, the control for decreasing the subsequent image productivity or the control for discontinuing the job is performed within general performance power supply with ease. The reference temperature for determining such lowering of the image productivity or discontinuation of the job is set to be lower in the single-color mode than the full-color mode. As a result, both of the fusing property and the high image productivity can be realized.

8 Claims, 17 Drawing Sheets

*Fig.3*

| | FIXING ROLLER TEMPERATURE | | | | | | | |
|---|---|---|---|---|---|---|---|---|
| | 190°C | 180°C | 175°C | 170°C | 165°C | 160°C | 155°C | 150°C |
| SINGLE-COLOR IMAGE | ○ | ○ | ○ | ○ | ○ | ○ | ○ | × |
| FULL-COLOR IMAGE | ○ | ○ | ○ | × | × | × | × | × |

Fig.13

| | FIXING ROLLER TEMPERATURE | | | | | | | |
|---|---|---|---|---|---|---|---|---|
| | 190℃ | 180℃ | 175℃ | 170℃ | 165℃ | 160℃ | 155℃ | 150℃ |
| SINGLE-COLOR IMAGE | ○ | ○ | ○ | ○ | ○ | ○ | ○ | × |
| FULL-COLOR IMAGE | ○ | ○ | ○ | × | × | × | × | × |

IMAGE FORMING APPARATUS

BACKGROUND OF THE INVENTION

1. Field of the Invention

The present invention relates to an image forming apparatus of electrophotographic type or electrostatic recording type and, in particular, an image forming apparatus such as a copying machine, a printer and a fax machine.

2. Description of the Related Art

In an image forming apparatus of electrophotographic type such as a printer and a copying machine that forms an image, a light image corresponding to an original is exposed on an electrostatic latent image bearing member such as a charged photosensitive member to form an electrostatic latent image, a developed toner image is formed on the electrostatic latent image by use of a developing means and the developed toner image is transferred on a recording material. Subsequently, in a fusing (fixing) device of heated roller type, a copied image corresponding to the original is formed by heating and pinching the recording material holding the toner image under pressure for fixation in a contact part (nipped part) between a fusing roller and a pressure roller.

In such fusing device, when the number of image outputs per unit time (hereinafter referred to as "productivity") is increased, heat quantity taken from the fusing roller by the recording material increases in proportion to the increase in productivity. Therefore, as the productivity of the image forming apparatus is increased, falling of the temperature of the fusing roller becomes substantive and imperfect fusing occurs when the fusing roller temperature falls below the temperature at which fusing property can be maintained (hereinafter referred to as "fusing minimum temperature").

A possible method for preventing this imperfect fusing is to increase electric power of heat source such as a halogen heater for heating the fusing roller, thereby to restrain falling of the fusing roller temperature. However, in the condition where temperature is easy to fall, for example, under low temperature or just after the time when the main unit is turned on, it is very difficult within general commercial power supply to feed the power enough to maintain the fusing roller temperature at the fusing minimum temperature or higher to the above-mentioned power source.

Accordingly, to avoid these problems, the control in which image formation is discontinued when the surface temperature of the fusing roller is detected and the detected temperature falls below a predetermined temperature, and is restarted when the detected temperature returns to the predetermined temperature is devised. The predetermined temperature is referred to as "stop temperature" and the control is referred to as "stop control".

The control in which an interval of image formation is increased when the surface temperature of the fusing roller is detected and the detected temperature falls below a predetermined temperature, thereby to lower the productivity and restrain falling of the surface temperature of the fusing roller is also devised. The predetermined temperature is referred to as "down temperature" and the control is referred to as "down control".

According to these two types of control, even in the condition where temperature is easy to fall such as low temperature surrounding, since the fusing roller temperature can be kept at the fusing minimum temperature or higher, the fusing property can be advantageously ensured.

For this reason, in the black-and-white copying machines and printers having high image productivity, the above-mentioned stop control and down control are performed. Further, according to the control, both high image productivity and fusing property can be realized within general commercial power supply.

Image productivity qualitatively represents the number of recording materials on which an image is formed per unit time and high productivity represents that the number of recording materials on which an image is formed per unit time is large.

On the other hand, the full-color image forming apparatus is generally configured so as to execute single-color mode of forming a single-color image by using one of magenta, cyan, yellow and black toners and full-color mode of forming a full-color image by mixing four colors of magenta, cyan, yellow and black toners. The user can select either of these modes as necessary.

In the full-color mode, in contrast to the single-color mode, since an image is formed by mixing four colors of toner, the maximum amount of toner held on the recording material becomes larger. Therefore, it is devised that the temperature at the fusing by the fusing roller in the full-color mode is higher than that in the single-color mode (for example, Unexamined Patent Publication No. 10-039673).

Although the high image productivity is desired also in the full-color image forming apparatus as in the black-and-white image forming apparatus, adoption of the above-mentioned stop control and down control causes the following problem.

That is, when the above-mentioned stop temperature and down temperature in the single-color mode and the full-color mode is uniformly set at the temperature at which fusing of the full-color image is ensured, despite that the fusing roller temperature falls within the range of temperatures at which the single-color image can be fixed, the operation proceeds to the stop control or down control during the job of forming the single-color image continuously, thereby to result in image productivity of single-color mode slowdown.

On the other hand, when the above-mentioned stop temperature and down temperature in the single-color mode and the full-color mode is uniformly set at the temperature at which fusing of the single-color image is ensured, imperfect fusing offset occurs due to low temperature offset and so on during the job of forming the full-color image continuously, in the event that the temperature falls below the temperature at which fusing of the full-color image is ensured.

As described above, in the conventional full-color image forming apparatus, it is difficult to realize image productivity and fusing property simultaneously.

SUMMARY OF THE INVENTION

An object of the present invention is to provide an image forming apparatus capable of improving the image productivity while maintaining the fusing property in the single-color mode and the full-color mode.

Another object of the present invention will be apparent by reading the following detailed description with reference to the appended figures.

To achieve the above-mentioned object, an image forming apparatus from a first aspect of the present invention comprises:

an image forming means capable of forming a multi-color image on a recording material;

a fixing means for heat-fixing the image formed on the recording material;

a detecting means for detecting temperature of the fixing means; and a means for decreasing the number of fixing operation per unit time when the detected temperature of the fixing means drops to a reference temperature during image formation, wherein the reference temperature in a single-color mode is lower than that in a multi-color mode.

An image forming apparatus from a second aspect of the present invention comprises:

an image forming means capable of forming a multi-color image on a recording material;

a fixing means for heat-fixing the image formed on the recording material;

a detecting means for detecting temperature of the fixing means; and a means for discontinuing image formation when the detected temperature of the fixing means drops to the reference temperature during image formation, wherein the reference temperature in a single-color mode is lower than that in a multi-color mode.

BRIEF DESCRIPTION OF THE DRAWINGS

The invention, together with further advantages thereof, may best be understood by reference to the following description taken in conjunction with the accompanying drawings in which:

FIG. 3 is a graph showing test results of fusing performance of a single-color image and a full-color image applied to the first to third embodiments of the present invention;

FIG. 13 is a table showing test results of fusing performance of a single-color image and a full-color image applied to the fifth embodiment of the present invention;

DESCRIPTION OF THE PREFERRED EMBODIMENTS

Figure 1:
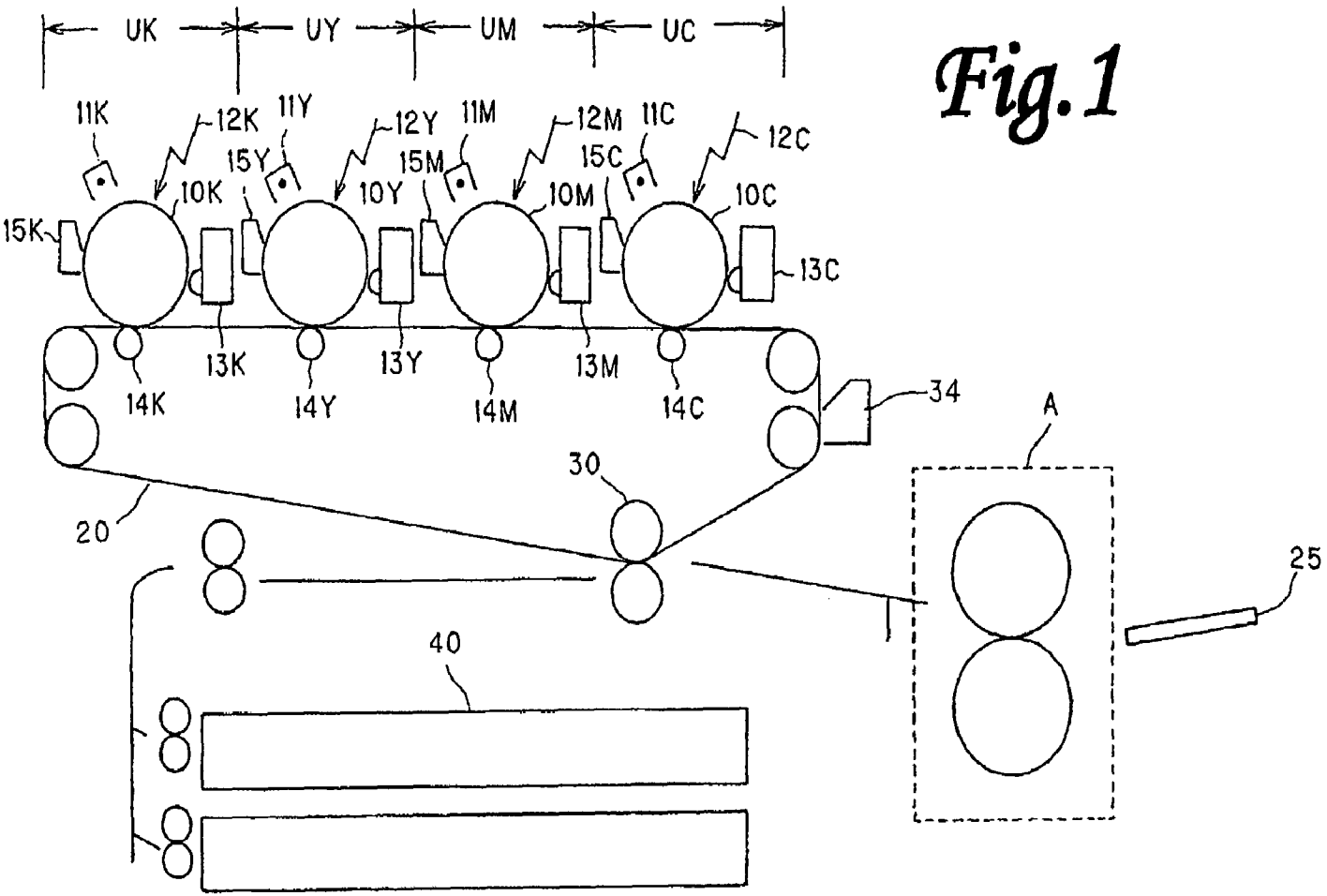
FIG. 1 is a cross-sectional view of an image forming apparatus in accordance with a first to third embodiments of the present invention.

Embodiments of the present invention will be described below with reference to the appended figures. In all figures of the embodiments, same reference numerals are given to the same or corresponding parts.

(First Embodiment)

Firstly, a full-color image forming apparatus in accordance with a first embodiment of the present invention will be described. FIG. 1 shows the configuration of a main part of the full-color image forming apparatus in accordance with the first embodiment.

As shown in FIG. 1, the full-color image forming apparatus in accordance with the first embodiment is configured so as to have a plurality of image forming units UC (cyan unit), UM (magenta unit), UY (yellow unit) and UK (black unit). An intermediate transfer belt 20 is disposed so as to run right across these image forming units UC, UM, UY and UK. In the first embodiment, the configuration of only the image forming unit UC is described. The configuration of the other image forming units UM, UY and UK is the same as that of the image forming unit UC and therefore description thereof is not repeated here.

The image forming unit UC is configured so as to have a photosensitive member 10C, a primary charger 11C, an image exposing unit 12C, a development unit 13C, a transfer roller 14C and a cleaner 15C.

The photosensitive member 10C is a cylindrical photosensitive member as a rotatable electrostatic latent image holding member that has an optical semiconductor layer formed of amorphous silicon on the surface of a conductive substrate. The primary charger 11C is located in a non-contacting state with respect to the photosensitive member 10C.

The image exposing unit 12C is configured so as to expose the photosensitive member 10C at the downstream from the primary charger 11C in the rotating direction of the photosensitive member 10C. The development unit 13C is located adjacent to the photosensitive member 10C at the downstream from the exposure position of the photosensitive member 10C.

The transfer roller 14C is located so as to be opposed to the photosensitive member 10C sandwiching the intermediate transfer belt 20 therebetween at a primary transfer position. The intermediate transfer belt 20 is sandwiched between the photosensitive member 10C and the transfer roller 14C. The cleaner 15C serves to clean toner remained on the surface of the photosensitive member 10C.

Next, an example of operations of the image forming apparatus thus configured, that is, an example of operations of the image forming unit UC in the single-color mode during image formation will be described. Since operations in the single-color mode of magenta, cyan and black are similar, description thereof is not repeated here.

The photosensitive member 10C is configured so as to rotate along a cylindrical axis. The surface of the photosensitive member 10C is negatively charged in a uniform manner by the primary charger 11C performing corona discharge and then the photosensitive member 10C is exposed by the image exposing unit 12C to form an electrostatic latent image corresponding to an original.

The development unit 13C develops the electrostatic latent image using the negatively charged toner and forms the toner image corresponding to the electrostatic latent image on the surface of the photosensitive member 10C. The toner image formed on the surface of the photosensitive member 10C is transferred on the intermediate transfer belt 20 by the electric field of the transfer roller 14C.

For operations in the full-color mode during image formation, the above-mentioned operations are performed in each of the image forming units UC, UM, UY and UK and toner images formed on the respective photosensitive members 10C, 10M, 10Y and 10K are multi-layer transferred on the intermediate transfer belt 20 sequentially.

In the full-color mode, the toner images are transferred on the intermediate transfer belt 20 in the order of C (cyan), M (magenta), Y (yellow) and K (black). Similarly in the single-color or two or three-color mode, required toner images are multi-layer transferred on the intermediate transfer belt 20 sequentially. The residual toner remained on the respective photosensitive members 10C, 10M, 10Y and 10K is cleaned by the cleaners 15C, 15M, 15Y and 15K.

The toner image multi-layer transferred on the intermediate transfer belt 20 sequentially is transferred on a recording material 7 fed from a sheet feeding unit 40 in a secondary transfer unit 30 in sync with the timing of an image unit of the intermediate transfer belt 20. The residual toner remained on the intermediate transfer belt 20 is cleaned by a cleaner 34. Then, the recording material on which the toner image is transferred is transported to a fusing device A and heated, and after fixation by the melting of toner, discharged to a discharge tray 25.

The full-color image forming apparatus in accordance with the first embodiment is configured so that the user can arbitrarily select either single-color mode or full color mode through a liquid crystal display unit as an operation unit. As described later, when the automatic mode for reading out a plurality of originals in which single-color originals and full-color originals are mixed to discriminate black-and-white image from color image is loaded, the full-color image forming apparatus is configured so that the user can arbitrarily select such automatic mode in addition to the single-color mode and full color mode through the liquid crystal display unit.

Image productivity rate of the image forming apparatus of this embodiment is 50 cpm in both single-color mode and full color mode.

(Fusing Device)

Figure 2:
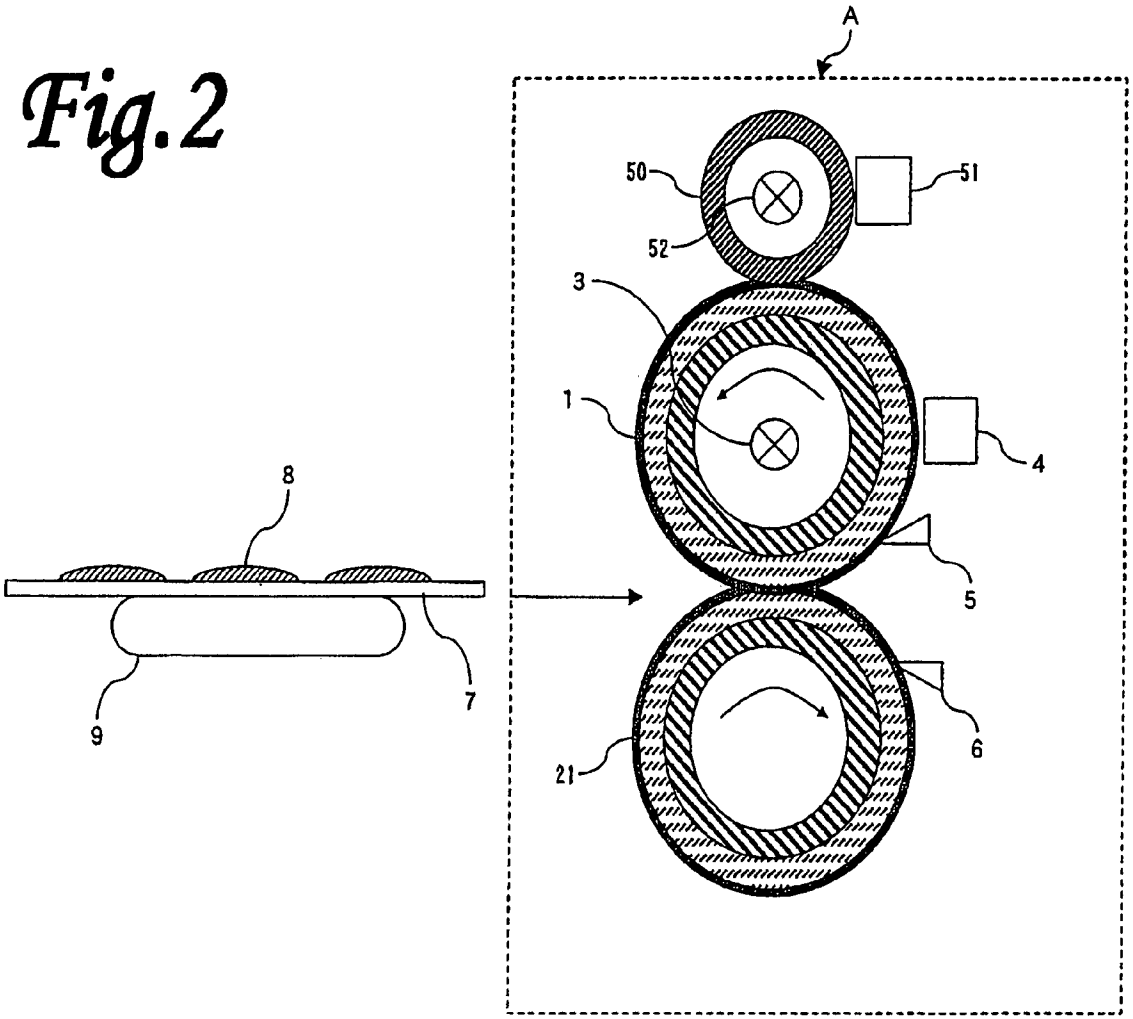
FIG. 2 is a cross-sectional view of a fusing device in accordance with the first to third embodiments of the present invention.

Next, the fusing device as fusing means in accordance with the first embodiment of the present invention will be described. FIG. 2 shows a main part of the fusing device A of the first embodiment.

The fusing device A is configured so as to have a fusing roller 1 as a fusing member and a pressure roller 2 as pressuring member, which are brought into contact with each other at surfaces thereof and arranged rotatably, a heater 3 as heating means comprised of a halogen lamp disposed at the center of a cylinder of the fusing roller along the direction of a rotational axis, a temperature sensor 4 as temperature detecting means that comes into contact with the fusing roller 1 and can detect surface temperature, a recording material 7 conveyed, carrying an unfixed toner image 8 thereon, a conveying guide 9 that guides the recording material 7 into a contact part (nipped part) between the fusing roller 1 and the pressure roller 2 and separation claws 5, 6 that are brought into contact with or adjacent to the surfaces of fusing roller 1 and the pressure roller 2, respectively for separating the recording material. Further, the fusing device A contains an external heating roller 50 having a heater 52 as heating means comprised of a halogen lamp therein, which is rotatably disposed in contact with the surface of the fusing roller 1 and rotates while heating the surface of the fusing roller 1. The fusing device A further has a temperature sensor 51 as temperature detecting means that comes into contact with the external heating roller 50 and can detect surface temperature.

The fusing roller 1 is formed by coating the surface of aluminum cylinder having an external diameter of 60 mm and a thickness of 3 mm with silicone rubber having a thickness of 1.5 mm and JIS-A hardness of 40 to 70, for example. The above-mentioned rubber layer of the fusing roller 1 is provided to follow irregularity of the unfixed color toner. In this embodiment, a good image can be obtained by providing the rubber layer having a thickness of 1.5 mm or more. To improve releasability of the surface, for example, a fluororesin layer such as a polytetrafluoroethylene (PTFE) layer with thickness of 20 to 70 μm and a perfluoro alkoxy alkane (PFA) layer with thickness of 50 to 100 μm is provided.

The pressure roller 2 is formed by coating the surface of aluminum cylinder having an external diameter of 50 mm and a thickness of 2 mm with silicone rubber having a thickness of 2 mm and JIS-A hardness of 40 to 70, for example. To improve releasability of the surface, for example, a fluororesin layer such as a PTFE layer with a thickness of 20 to 70 μm and a PFA layer with a thickness of 50 to 100 μm is provided.

Load of 784 N (80 kgw), for example, is applied between the fusing roller 1 and the pressure roller 2. At this time, length of the contact part (nip length) between the fusing roller 1 and the pressure roller 2 is about 8.5 mm. A halogen lamp having specifications of voltage 100 V and power 500 W, for example, is used as the heater 3 built in the fusing roller 1.

To improve releasability of the surface, in the external heating roller 50, a fluororesin layer such as a PTFE layer with a thickness of 20 to 70 μm and a PFA layer with a thickness of 50 to 100 μm is formed on an aluminum cylinder having an external diameter of 30 mm and a thickness of 3 mm. A halogen lamp having specifications of voltage 100 V and power 300 W, for example, is used as the heater 52 built in the external heating roller 50.

(Temperature Control)

Next, temperature control of the fusing roller 1 and the external heating roller 50 in the fusing device A in accordance with the first embodiment will be described.

Firstly, after turn-on the power of the main unit, warm-up is performed until the fusing roller 1 reaches a target temperature, for example, 190° C. (warm-up mode). On completion of the warm-up mode, temperature control is continued so that the temperature of the fusing roller is kept at 190° C. in this case (stand-by mode). During the print mode, temperature control at the fusing roller temperature (for example 190° C.) is performed in both of single-color mode and full-color mode. Similarly, the external heating roller 50 is warmed up to a target temperature of 210° C. and after warm up, temperature control at the target temperature of 210° C. is continued. During the print mode, the external heating roller kept at 210° C. directly heats the fusing roller while rotating on the surface of the fusing roller, thereby to lower the temperature of the fusing roller more slowly.

FIG. 3 shows test results of fusing performances of the single-color image and the full-color image. The test is conducted under the rigid condition in terms of retention of fusing performances, that is, under the condition in which the amount of toner held on the recording material becomes maximized in an atmosphere of 10° C. The amount of toner held on the recording material of the single-color image is 0.6 mg per unit area (0.6 mg/cm$^2$) and the amount of toner held on the recording material of the full-color image is 1.2 mg per unit area (1.2 mg/cm$^2$)

FIG. 3 reveals that the fusing minimum temperature of the single-color image is 155° C. and the fusing minimum temperature of the full-color image is 170° C. Since the maximum amount of toner held on the recording material of the full-color image is generally larger than that of the single-color image, the fusing minimum temperature of the full-color image is lower than that of the single-color image.

(Control Unit)

Next, stop control during the single-color mode image formation and stop control during the full-color mode image formation will be described. The below-described control is carried out by sending a control signal from a control unit (not shown) provided in the image forming apparatus to each unit. A temperature signal is sent from the temperature sensor 4 to the control unit.

(Single-Color Mode)

The stop control in the single-color mode will be described referring to a flowchart in FIG. 8.

Figure 8:
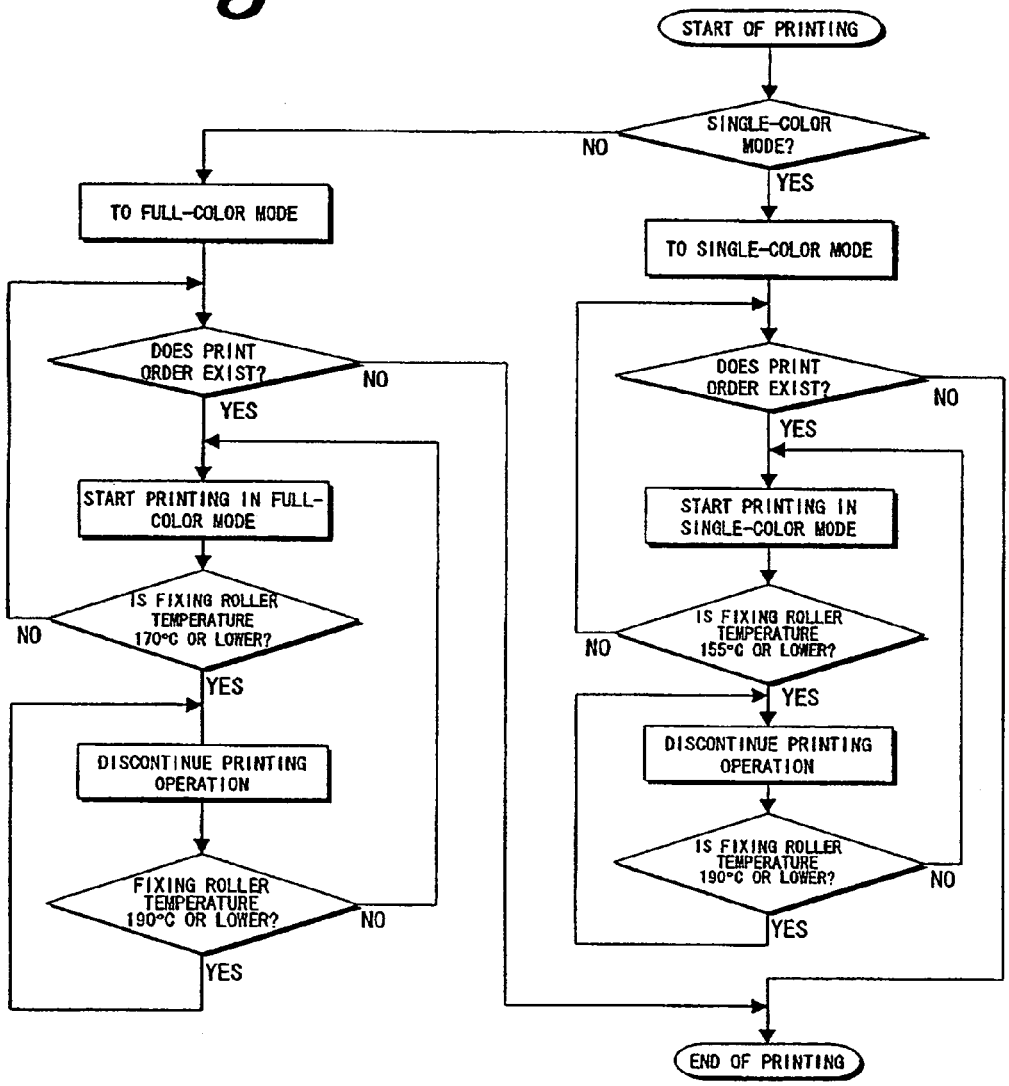
FIG. 8 is a flowchart showing stop control in the single-color mode and the full-color mode in accordance with the first embodiment of the present invention.

As shown in FIG. 8, firstly, it is determined whether or not a print order is the single-color mode. Here, when the print order is the single-color mode, the operation proceeds to printing in the single-color mode. During printing in the single-color mode, printing is continued according to the print order while the fusing roller temperature is 155° C. or higher. When the fusing roller temperature becomes 155° C. or lower, the operation generally proceeds to printing after the fusing roller temperature returns to 190° C. or higher. In the absence of the print order, the printing operation is finished.

Figure 4:
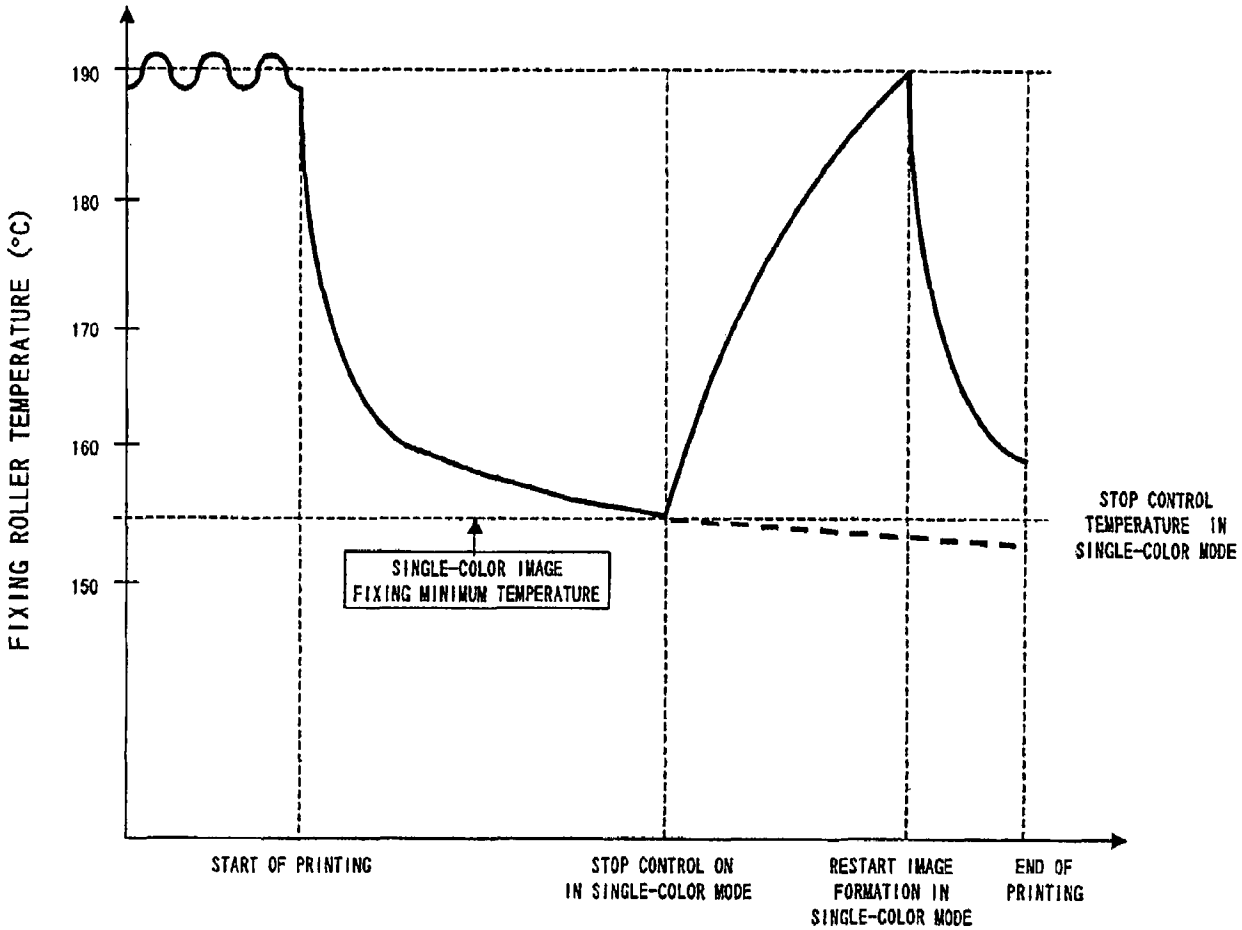
FIG. 4 is a graph showing shift in temperature of a fusing roller in a single-color mode in accordance with the first embodiment of the present invention.

FIG. 4 shows shift in temperature of the fusing roller 1 during continuous printing in the single-color mode according to the above-mentioned control. The fusing roller temperature falls slowly from 190° C. at the start of printing while being heated by the external heating roller 50 directly. When it is detected that the fusing roller temperature becomes a single-color mode stop temperature (for example 155° C. in this case) or lower, printing operation is discontinued.

Subsequently, the fusing roller is heated during discontinuation of printing operation, thereby to increase the fusing roller temperature, and when it is detected that the fusing roller temperature becomes an image formation restart temperature (for example 190° C.), control for restarting printing is carried out.

As a result, even when the fusing roller temperature falls greatly, for example, just after the time when the apparatus is turned on under low temperature or after long-time shutdown, the fusing roller temperature does not fall short of the above-mentioned fusing minimum temperature of the single-color image (for example 155° C.) and therefore the single-color image can obtain a good fusing property. Any image formation restart temperature higher than the fusing minimum temperature (155° C. in this case) can be set arbitrarily.

To prevent stop control from being performed immediately after restart of image formation, in the first embodiment, image forming operation is restarted at the fusing roller temperature of 190° C. The fusing roller temperature indicated by a broken line shows shift in temperature when stop control is not carried out.

(Full-Color Mode (Multi-Color Mode))

Figure 5:
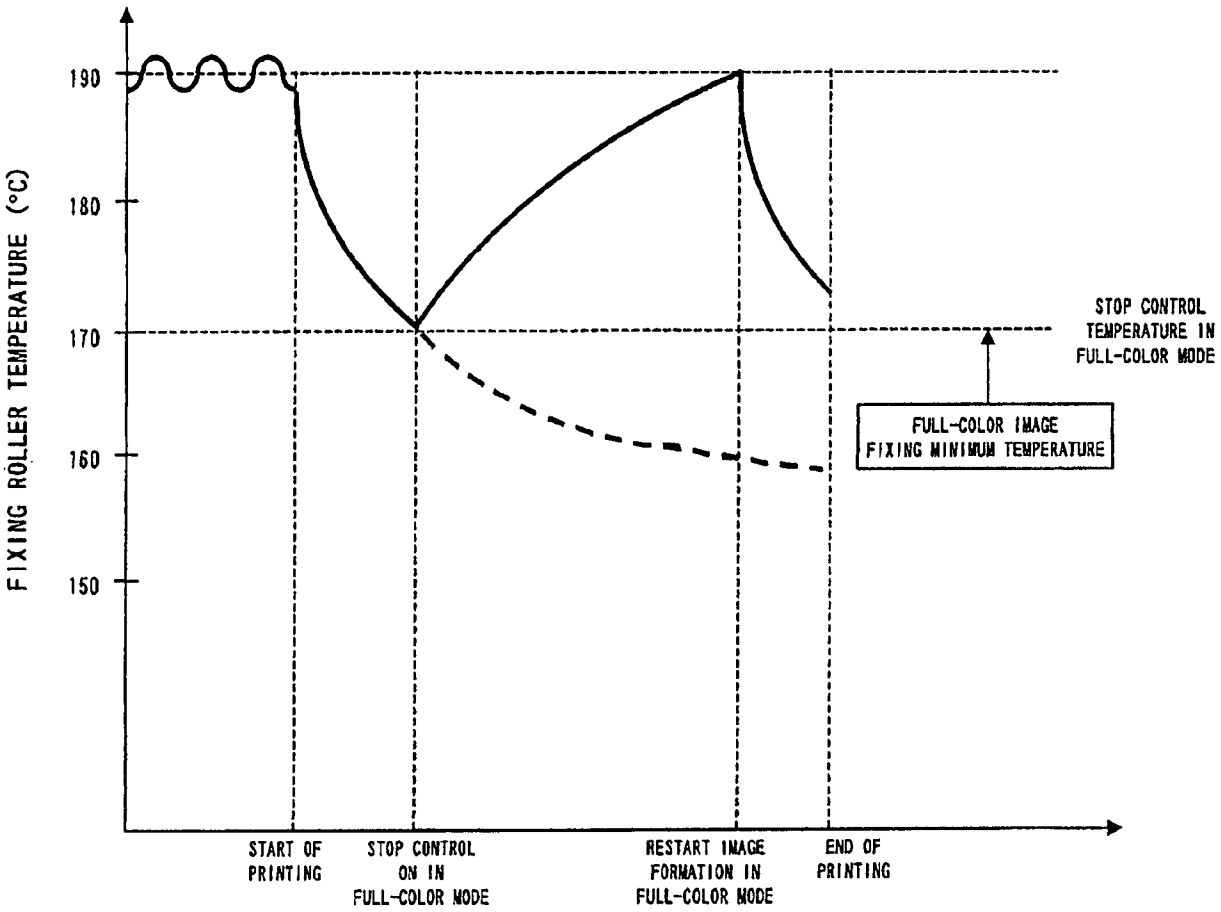
FIG. 5 is a graph showing shift in temperature of a fusing roller in a full-color mode in accordance with the first embodiment of the present invention.

The stop control in the full-color mode will be described referring to a flowchart in FIG. 8. Firstly, when the print order is the full-color mode, the operation proceeds to printing in the full-color mode. During printing in the full-color mode, printing is continued according to the print order while the fusing roller temperature is 170° C. or higher. When the fusing roller temperature becomes 170° C. or lower, the operation generally proceeds to printing after the fusing roller temperature returns to 190° C. or higher. In the absence of the print order, the printing operation is finished. FIG. 5 shows shift in temperature of the fusing roller 1 during continuous printing in the full-color mode according to the above-mentioned control.

As shown in FIG. 5, the fusing roller temperature at start of printing is 190° C., for example. When continuous printing is performed, the fusing roller temperature falls slowly while being heated by the external heating roller 50 directly. When it is detected that the fusing roller temperature becomes a full-color mode stop temperature (for example 170° C. in this case) or lower by the temperature sensor 4, printing operation is discontinued.

Subsequently, the fusing roller 1 is heated by the heater 3 during discontinuation of printing operation, thereby to increase the temperature of the fusing roller 1, and when it is detected that the fusing roller temperature reaches to 190° C., control for restarting printing is carried out. As a result, even when the fusing roller temperature falls greatly, for example, just after the time when the apparatus is turned on under low temperature or after long-time shutdown, the fusing roller temperature does not fall short of the above-mentioned fusing minimum temperature of the full-color image (for example 170° C. in this case) and therefore the full-color image can obtain a good fusing property. Any image formation restart temperature higher than the fusing minimum temperature (for example 170° C.) can be set arbitrarily.

To prevent stop control from being performed immediately after restart of image formation, in the first embodiment, image forming operation is restarted at the fusing roller temperature (for example 190° C. in this case) The fusing roller temperature indicated by a broken line in FIG. 5 shows shift in temperature when stop control is not carried out.

(Comparison with the Conventional Stop Control)

Next, the stop control according to the first embodiment will be compared with the stop control according to the related art. From the inventor's viewpoint, in the case where stop temperature is set to be uniform whether the single-color mode or full color mode as in the stop control according to the related art, the below-mentioned two problems occur.

Firstly, in the case where the stop temperature is set at the fusing minimum temperature of the full-color image, for example, 170° C. so as to ensure the fusing property of the full-color mode, although the fusing property of the single-color mode is ensured up to the fusing minimum temperature of the single-color image (for example 155° C.), image formation is interrupted when the fusing roller temperature falls below 170° C. In this case, inherent productivity of the apparatus cannot be exhibited.

Secondly, in the case where the stop temperature is set at the fusing minimum temperature of the single-color mode, for example, 155° C., imperfect fusing occurs when the fusing roller temperature in the full-color mode falls below the fusing minimum temperature of the full-color image (for example, 170° C. in this case).

On the contrary, according to the first embodiment, in the full-color image forming apparatus having at least single-color mode and full-color mode, the stop temperature in the single-color mode corresponds to the fusing minimum temperature of the single-color image and the stop temperature in the full-color mode corresponds to the fusing minimum temperature of the full-color image so that the fusing minimum temperature varies depending on the single-color mode or the full-color mode. This can maintain good fusing property of both single-color image and full-color image without lowering the productivity of the image forming apparatus unnecessarily.

(Second Embodiment)

Next, an image forming apparatus in accordance with a second embodiment will be described. In the second embodiment, at the time when the temperature detected by the temperature sensor 4 becomes a predetermined down temperature or lower, interval between each image formation is increased by a control unit (not shown), thereby to lower the productivity of the main unit and restrain falling of the fusing roller temperature. In the down control for ensuring fusing property, an excellent fusing property can be maintained in both single-color image and full-color image by changing the down temperature between the single-color mode and the full-color mode.

Taking continuous printing in the two modes of the single-color mode and the full-color (multi-color) mode as an example, the down control in accordance with the second embodiment will be described. Since the configuration of the image forming apparatus and the fusing device as well as fusing property in the single-color mode and the full-color mode as shown in FIG. 3 are similar to those in the above-mentioned first embodiment, description thereof is not repeated here.

(Single-Color Mode)

Figure 6:
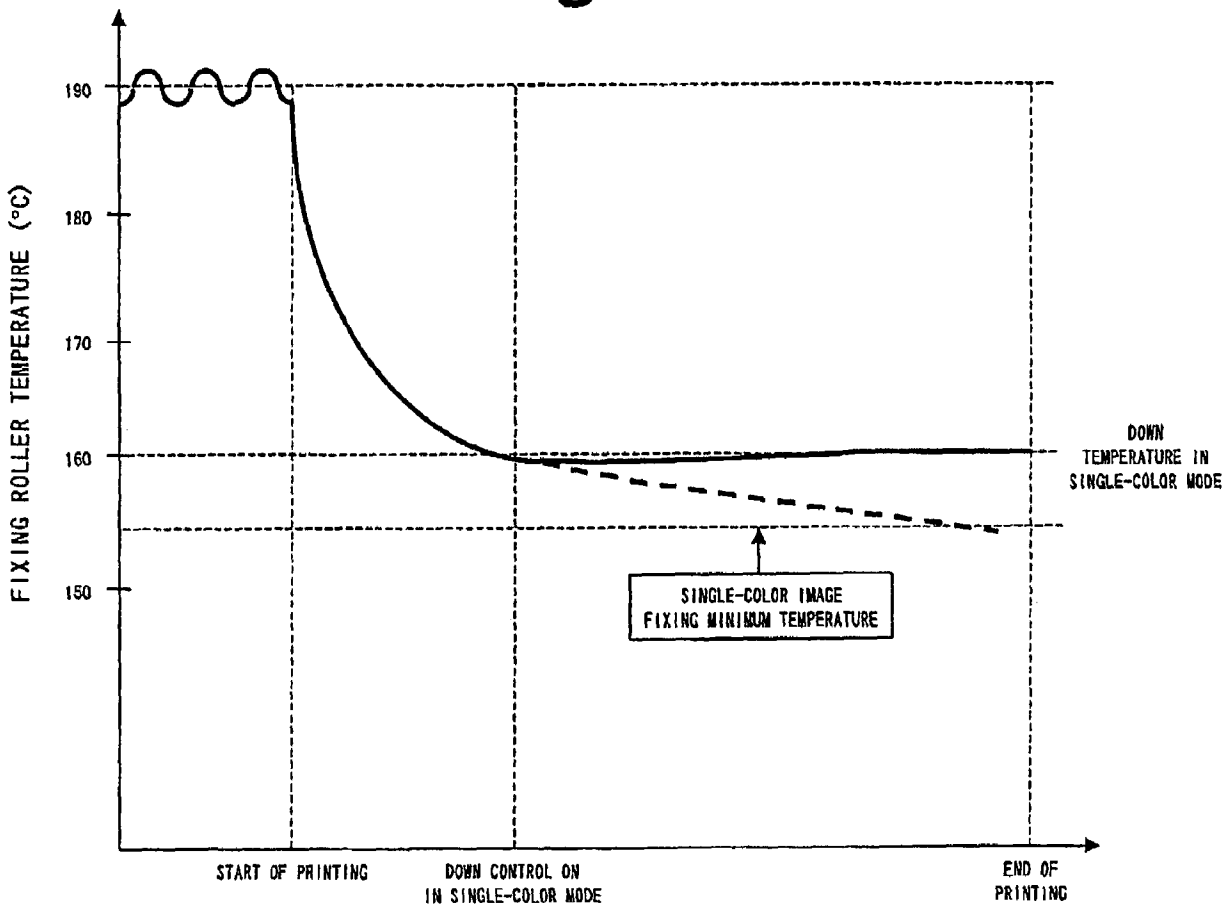
FIG. 6 is a graph showing shift in temperature of a fusing roller in a single-color mode in accordance with the second embodiment of the present invention.
Figure 9:
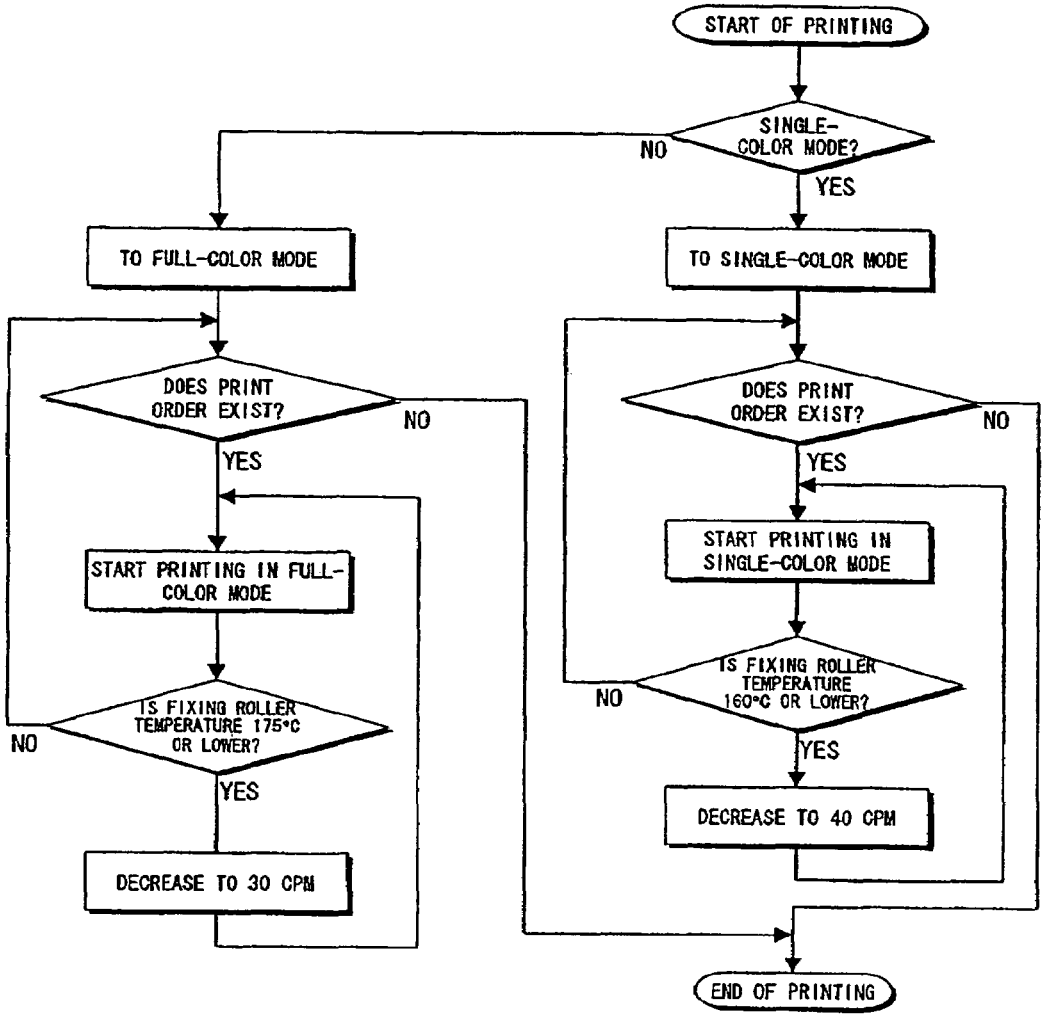
FIG. 9 is a flowchart showing down control in the single-color mode and the full-color mode in accordance with the second embodiment of the present invention.

Firstly, the down control in the single-color mode will be described referring to a flowchart in FIG. 9. Firstly, it is determined whether or not a print order is the single-color mode. As a result, when the print order is the single-color mode, the operation proceeds to printing in the single-color mode. During printing in the single-color mode, printing is continued according to the print order while the fusing roller temperature is 160° C. or higher. When the fusing roller temperature becomes 155° C. or lower, the productivity is lowered to 40 cpm. FIG. 6 shows shift in temperature of the fusing roller 1 during continuous printing in the single-color mode according to the above-mentioned control.

That is, as shown in FIG. 6, the fusing roller temperature falls slowly due to continuous printing from 190° C. at the start of printing while being heated by the external heating roller 50 directly. When the fusing roller temperature detected by the temperature sensor 4 becomes a single-color mode down temperature of 160° C. or lower, interval between each image formation is increased. Since the productivity is generally 50 cpm, the productivity at this time is lowered to 40 cpm. Accordingly, the fusing roller temperature is restrained from falling and the fusing roller temperature after the down control can be maintained at the fusing minimum temperature of 155° C. of the single-color image or higher and at the same time, an excellent fusing property of the single-color image can be obtained. In the second embodiment, the down temperature is set to be higher than the fusing minimum temperature by 5° C. Even if the down control is performed when the temperature that is equal to or higher than the predetermined temperature (160° C.) is detected as the temperature of the fusing roller 1, the temperature of the fusing roller 1 may fall below the down control due to undershoot of falling of the fusing roller temperature. The above-mentioned 5° C. is a margin for preventing the fusing roller temperature from falling below the fusing minimum temperature. The fusing roller temperature represented by a dashed line shows shift in temperature when the down control is not carried out.

(Full-Color Mode)

Next, the down control in the full-color mode will be described referring to a flowchart in FIG. 9. Firstly, it is determined whether or not a print order is the single-color mode. As a result of determination, when the print order is the full-color mode (single-color mode: No), the operation proceeds to printing in the full-color mode.

During printing in the full-color mode, printing is continued according to the print order while the fusing roller temperature is 175° C. or higher. When the fusing roller temperature becomes 175° C. or lower, the productivity is lowered to 30 cpm.

Figure 7:
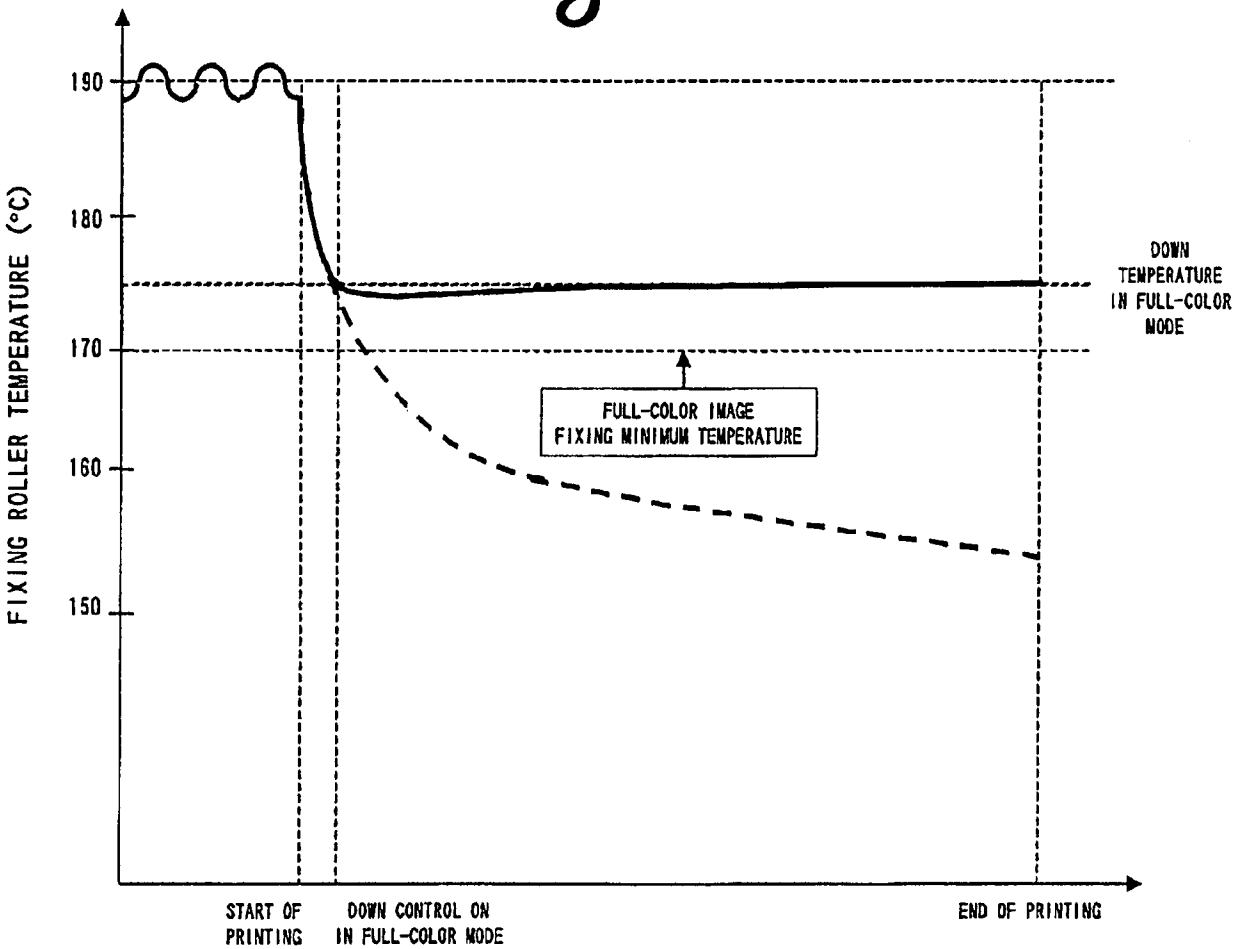
FIG. 7 is a graph showing shift in temperature of a fusing roller in a full-color mode in accordance with the second embodiment of the present invention.

FIG. 7 shows shift in temperature of the fusing roller 1 during continuous printing in the full-color mode according to the above-mentioned control. The fusing roller temperature falls slowly due to continuous printing from 190° C. at the start of printing while being heated by the external heating roller 50 directly. When the detected fusing roller temperature becomes 175° C. or lower, interval between each image formation is increased and the general productivity is lowered from 50 cpm to 30 cpm. Accordingly, since the fusing roller temperature is restrained from falling and the fusing roller temperature after the down control can be maintained at the fusing minimum temperature of 170° C. of the full-color image or higher, an excellent fusing property of the full-color image can be obtained. As in the single-color mode, the down temperature in the full-color mode is also set to be higher than the fusing minimum temperature by 5° C. for a similar-reason.

In the second embodiment, during the down control, while the productivity is lowered to 40 cpm in the single-color mode, the productivity is lowered to 30 cpm in the full-color mode. It is due to difference in target temperature at which the fusing roller temperature is maintained after the down control. That is, 30 cpm is a proper productivity to maintain the fusing roller temperature at 175° C. and 40 cpm is a proper productivity to maintain the fusing roller temperature at 160° C. The fusing roller temperature represented by a dashed line shows shift in temperature when the down control is not carried out. Although the distance between recording materials is increased to decrease the productivity during the down control in this embodiment, the productivity may be changed by slowing down the rate of conveying the recording material.

From the inventor's viewpoint, in the case where the down temperature is uniformly set at the same temperature whether the single-color mode or the full-color mode, as in the down control according to the related art, the following problems occur.

Firstly, in the case where the down temperature is set at 175° C. obtained by adding 5° C. as a margin to the full-color mode fusing minimum temperature to ensure the fusing property in the full color mode, despite that fusing can be ensured up to the fusing minimum temperature of the single-color image (for example 155° C. in this case) in the single-color mode, the productivity is lowered at the time when the fusing roller temperature falls below 175° C., resulting in that inherent productivity of the apparatus cannot be exhibited.

Secondly, in the case where the down temperature is set at 160° C. obtained by adding 5° C. as a margin to the single-color mode fusing minimum temperature, imperfect fusing occurs at the time when the fusing roller temperature falls below the full-color image fusing minimum temperature (for example 170° C.) in the full-color mode.

On the contrary, according to the second embodiment, in the full-color image forming apparatus having at least the single-color mode and the full-color mode, both single-color image and full-color image can obtain an excellent fusing property without lowering productivity of the image forming apparatus unnecessarily by setting the down temperature corresponding to the single-color image fusing minimum temperature in the single-color mode and the down temperature corresponding to the full-color image fusing minimum temperature in the full-color mode.

(Third Embodiment)

Next, an image forming apparatus in accordance with a third embodiment of the present invention will be described.

In the third embodiment, two types of control, that is, the stop control of changing the stop temperature in the single-color mode and the full-color mode in the first embodiment and the down control of changing the down temperature in the single-color mode and the full-color mode in the second embodiment are used together.

In this case, the down temperature is set to be bit higher than the fusing minimum temperature and the stop temperature is set at the fusing minimum temperature. Using two types of control together in the image forming apparatus, for example, under the atmosphere of 15° C. as the image assured minimum temperature, the productivity is lowered by the down control to maintain the temperature of the fusing minimum temperature or higher for ensuring the fusing property, and under the atmosphere of 5° C. less than the image assured minimum temperature, when the fusing roller temperature falls below fusing minimum temperature even after the productivity is lowered by the down control, the stop control is used for ensuring the fusing property.

Therefore, it is possible to obtain the similar effects to those in the first and second embodiments and to set the productivity after the down control so that the fusing roller temperature does not fall below the fusing minimum temperature within the scope of temperature in general service condition.

In the above-mentioned first to third embodiments, the following two problems in the related art from the inventor's viewpoint can be solved.

It becomes possible to prevent the problem that when the stop temperature or the down temperature is set corresponding to the fusing minimum temperature in the single-color mode, the fusing property cannot be ensured in the full-color mode having the fusing minimum temperature higher than the single-color mode, thereby to cause imperfect fusing. It becomes possible to prevent the problem that when the stop temperature or the down temperature is set corresponding to the fusing minimum temperature in the full-color mode with the higher fusing minimum temperature, the operation of image formation is interrupted or the productivity is lowered unnecessarily even at the fixable temperature in the single-color mode. Therefore, in the full-color image forming apparatus, both productivity and fusing property can be realized by the stop control and the down control.

(Fourth Embodiment)

Next, an image forming apparatus in accordance with a fourth embodiment of the present invention will be described. The above-mentioned first, second and third embodiments, the control during printing the single-color mode and the full-color mode is described. Meanwhile, in the fourth embodiment, a mode of printing a plurality of originals in which the single-color original and the full-color original are mixed (hereinafter referred to as "mixed mode") is described.

Specifically, the full-color image forming apparatus in accordance with the fourth embodiment is configured so that the user arbitrarily select the mixed mode as an automatic mode of automatically determining whether the original is the full-color image or the single-color image in addition to the single-color mode and the full-color mode in a liquid crystal display unit as an operational unit. When the user does not designate the single-color mode or the full-color mode, the above-mentioned automatic mode is set in the control device.

When selecting the single-color mode or the full-color mode, the similar control to that in the first to third embodiments is performed. This enables obtaining the similar effects to those in the first to third embodiments.

Figure 10:
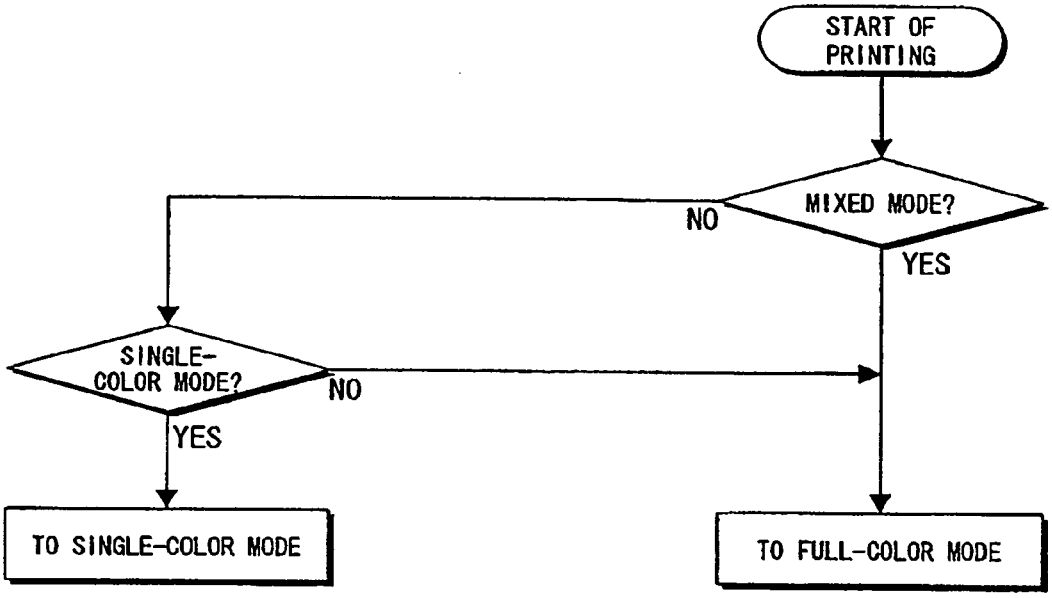
FIG. 10 is a flowchart showing control in mixed mode in accordance with a fourth embodiment of the present invention.

When the user select the mixed mode, as shown in a flowchart of FIG. 10, the stop control and the down control as in the first, second and third embodiments are performed by setting the stop temperature or the down temperature in the mixed mode at the stop temperature or the down temperature in the full-color mode.

Accordingly, since the fusing roller temperature is prevented from falling the fusing minimum temperature whether original is single-color one or the full-color one in the mixed mode, an excellent fixed image can be maintained also in the mixed mode.

(Fifth Embodiment)

Figure 12:
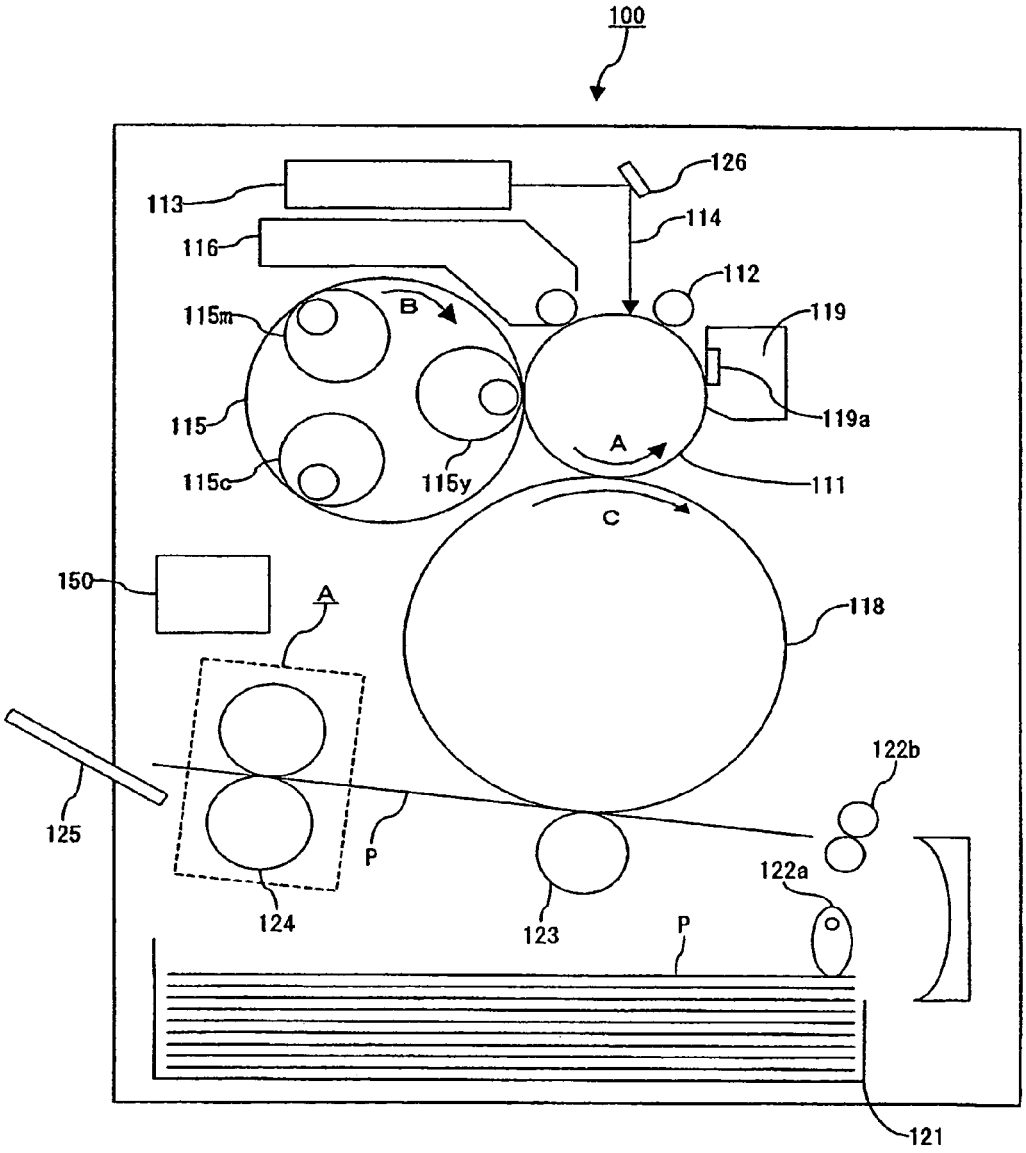
FIG. 12 is a schematic cross-sectional view of a color image forming apparatus of electrophotographic type (color laser printer) in accordance with the fifth embodiment of the present invention.

Next, an image forming apparatus in accordance with a fifth embodiment of the present invention will be described. FIG. 12 shows a color image forming apparatus of electrophotographic type (color laser printer) in accordance with the fifth embodiment of the present invention.

(Schematic Configuration of Image Forming Apparatus)

As shown in FIG. 12, the color image forming apparatus (hereinafter referred to as "image forming apparatus") 100 in accordance with the fifth embodiment is configured to have a photosensitive drum 111 as a photosensitive member, a charging roller 112 as a charging means, an exposure device 113 as an exposing means, an intermediate transfer drum 118 as a developing means and intermediate transfer means and a fusing device A as a fusing means.

The photosensitive drum 111 is comprised of an aluminum cylinder having a diameter of 60 mm, for example, and an organic photoconductive member (OPC) layer formed on the external surface of the aluminum cylinder. The photosensitive drum 111 is rotatably supported with respect to a cleaner container 119 and has a cleaning blade 119*a* and a charging roller 112 as a primary charging means on its periphery. Further, the photosensitive drum 111 is driven so as to rotate in the direction of an arrow C by a driving motor (not shown).

The charging roller 112 is a conductive roller and contacts with the photosensitive drum 111. The surface of the photosensitive drum 111 becomes negatively charged uniformly by applying a bias to the charging roller 112.

The photosensitive drum 111 is exposed by a laser exposure device 113. The laser exposure device 113 is controlled to turn ON or OFF by a controller unit (not shown) The photosensitive drum 111 is selectively exposed to a laser light 14 reflected from a reflecting mirror 26 to form an electrostatic latent image.

The developing means transforms the above-mentioned electrostatic latent image into a visible image. The developing means is comprised of a black development unit 16 and a rotary development unit 15. The rotary development unit 15 contains development units 15Y, 15M and 15C for each color of yellow (Y), magenta (M) and cyan (C) therein.

These color toner development units 15Y, 15M and 15C each rotate in the direction of an arrow B so as to be opposed to the photosensitive drum 111 sequentially to perform development by using each color toner.

The black development unit 16 is configured so as to form a visible image on the photosensitive drum 111 by using black toner. A developing sleeve provided with the black development unit 16 is disposed facing to the photosensitive drum 111 with a minute spacing (about 300 μm) therebetween.

The intermediate transfer drum 118 as an intermediate transfer member is urged against the photosensitive drum 111 with a predetermined pressing force. When the toner image on the photosensitive drum 111, which is transformed into a visible image by the above-mentioned developing means, is transferred to the intermediate transfer drum 118, a predetermined voltage having a polarity opposite to charged polarity (−) is applied.

A recording material P is fed from a sheet feeding cassette 121 to the intermediate transfer drum 118 through a feed roller 122*a* and transport roller 122*b*. In a transfer unit consisting of the intermediate transfer drum 118 and a transfer roller 123 that are opposed to each other, the toner image on the intermediate transfer drum 118 is transferred to the recording material P by applying the voltage having a polarity opposite to toner to the transfer roller 123 from behind the recording material P. The recording material P to which the toner image is transferred is transported to the fusing device A and discharged to a discharge tray 125 after fusing by heating and melting.

In the above-mentioned image forming apparatus 100, to obtain a full-color image, it is necessary to develop the electrostatic latent image on the photosensitive drum 111 four times by using each of the color toners (yellow, magenta, cyan and black), transfers the developed images on the photosensitive drum 111 to the intermediate transfer drum 118 and then transfers the images to the recording material P together. Accordingly, the time to form the full-color image is four times as long as the time to form the single-color image, which requires only one intermediate transfer.

Here, the image productivity of the image forming apparatus 100 in accordance with the fifth embodiment is set to be 15 cpm (the number of image formation in the full-color mode per one minute is 15) and 60 cpm (the number of image formation in the single-color mode per one minute is 60).

(Fusing Device)

Figure 11:
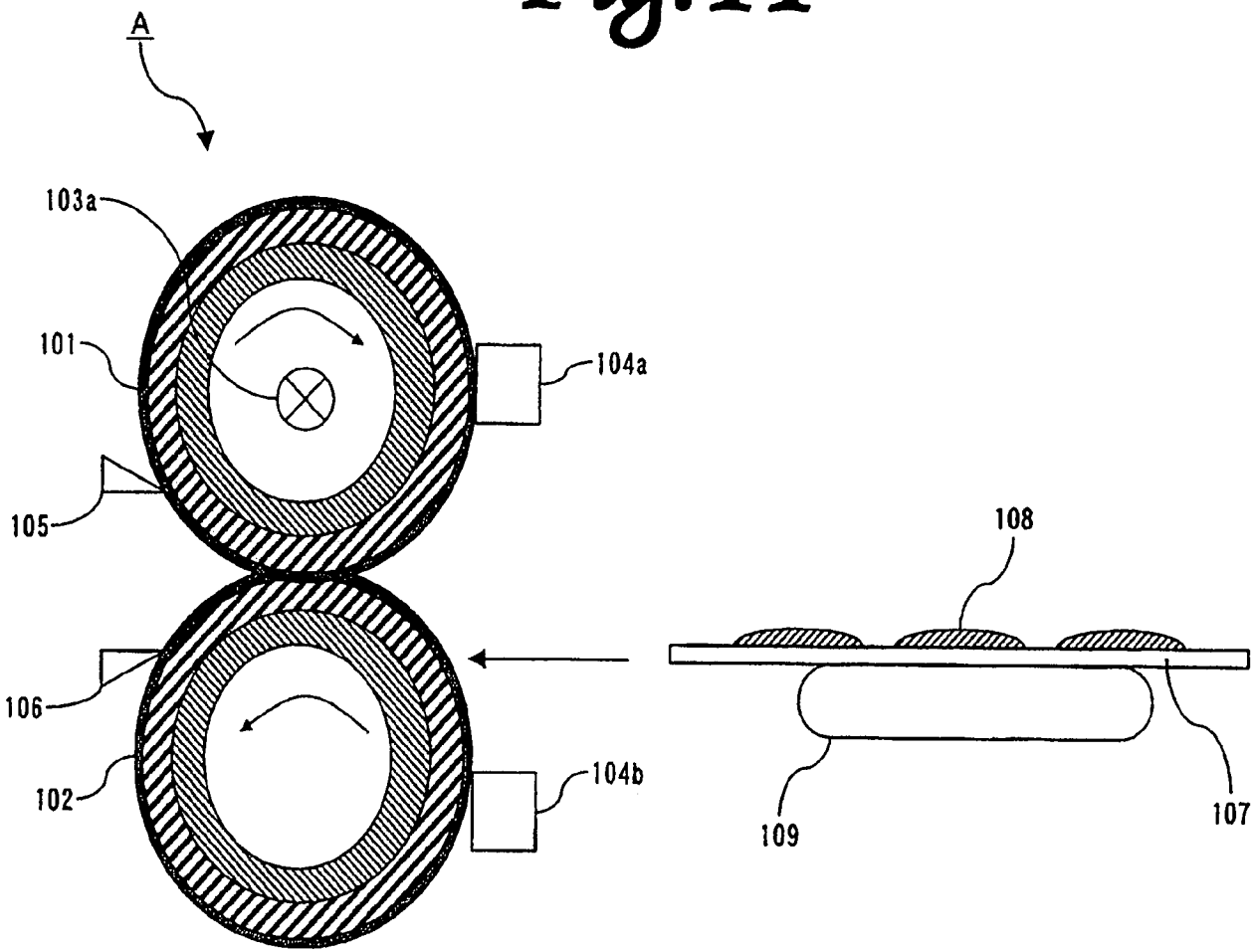
FIG. 11 is a schematic cross-sectional view of a fusing device A in accordance with a fifth embodiment of the present invention.

FIG. 11 is a schematic cross-sectional view of the fusing device A in accordance with the fifth embodiment of the present invention. As shown in FIG. 11, the fusing device A has an elastic layer. Further, the fusing device A has a fusing roller 101 as a fusing member, a pressure roller 102 as a pressurizing member and heaters 103*a*, 103*b* as heat generating members for heating. The fusing roller 101 is formed so as to rotate with respect to the main body of the image forming apparatus 100. The pressure roller 102 is urged against the surface of the fusing roller 101 with a pressure. The heaters 103*a*, 103*b* as heat generating members are halogen lamps that are located at the center part in the cylinders of the fusing roller 101 and the pressure roller 102 along the rotational axis and the like.

Further disposed are temperature sensors 104*a*, 104*b* as temperature detecting member that are brought into contact with the fusing roller 101 and the pressure roller 102 and can detect the surface temperature of these rollers, a transport guide 109 for guiding the recording material P transported while holding unfixed toner images 108 thereon to a contact part (nipped part) between the fusing roller 101 and the pressure roller 102, and separation claws 105, 106 that are brought into contact with or adjacent to the surfaces of fusing roller 101 and the pressure roller 102, respectively for separating the recording material P. Although the configuration using the fusing roller and pressure roller is adopted in the fifth embodiment, such components are not limited to rollers and the fusing means using a belt may be adopted.

The fusing roller 101 is formed by coating the surface of the cylinder with the elastic layer. The cylinder is, for example, an aluminum cylinder having an external diameter of 50 mm and a thickness of 3 mm. The elastic layer is, for example, a silicone rubber having a thickness of 2 mm and JIS-A hardness of 40 to 70. To improve releasability of the surface, for example, a fluororesin layer such as a PTFE layer with a thickness of 20 to 70 μm and a PFA layer with a thickness of 50 to 100 μm is provided.

The pressure roller 102 is formed by coating the surface of the cylinder with the elastic layer. The cylinder is, for example, an aluminum cylinder having an external diameter of 50 mm and a thickness of 2 mm. The elastic layer is, for example, a silicone rubber having a thickness of 2 mm and JIS-A hardness of 40 to 70. To improve releasability of the surface, for example, a fluororesin layer such as a PTFE layer with a thickness of 20 to 70 μm and a PFA layer with a thickness of 50 to 100 μm is provided.

For example, load of 80 kg (784 N) is applied between the fusing roller 101 and the pressure roller 102. The length of the contact part (the length of the nipped part) between the fusing roller 101 and the pressure roller 102 is 8.0 mm when the load is applied.

A halogen lamp having specifications of voltage 100 V and power 700 W, for example, is used as the heater 103*a* built in the above-mentioned fusing roller 101. A halogen lamp having specifications of voltage 100 V and power 200 W, for example, is used as the heater 103*b* built in the above-mentioned pressure roller 102.

(Temperature Control of Fusing Device)

Next, temperature control of the fusing roller 101 and the pressure roller 102 in the fusing device in accordance with the fifth embodiment will be described.

In the fifth embodiment, firstly, after turn-on the power of the main body of the image forming apparatus 100, the temperature of a thermistor as a temperature detecting member that is provided at each of the fusing roller 101 and the pressure roller 102 is detected and warmed up to each target temperature by a current control means for controlling the amount of current fed to the heater (warm-up mode). In the fifth embodiment, the warm-up target temperature of the fusing roller 101 is set at 190° C. and the warm-up target temperature of the pressure roller 102 is set at 160° C.

On completion of the warm-up mode, temperature control is performed so that the temperature of the fusing roller 101 becomes 190° C. and the temperature of the pressure roller 102 becomes 160° C. (stand-by mode)

During the print mode in which an image is formed, temperature control is performed so that the at the temperature of the fusing roller-101 is kept at 190° C. and the temperature of the pressure roller 102 is kept at 160° C. in the single-color mode and the full-color mode.

FIG. 13 shows test results of fusing performances of the single-color image and the full-color image. The test is conducted under the rigid condition in terms of retention of fusing performances, that is, under the condition in which the amount of toner held on the recording material becomes maximized in an atmosphere of 15° C. In the fifth embodiment, the maximum amount of toner held on the recording material of the single-color image is set to be 0.6 mg/cm$^2$ and the maximum amount of toner held on the recording material of the full-color image is set to be 1.2 mg/cm$^2$.

As a result, the fusing minimum temperature of the single-color image (single-color mode fusing minimum temperature) is 155° C. and the fusing minimum temperature of the full-color image (full-color mode fusing minimum temperature) is 175° C. As described in description of related art, since the maximum amount of toner held on the recording material of the full-color image is larger than that of the single-color image, the fusing minimum temperature of the full-color image is higher than that of the single-color image.

In the fifth embodiment, when the full-color mode is performed following the single-color mode, the fusing roller temperature temporarily falls below the fusing minimum temperature in the full-color mode and the single-color mode due to external factors such as the amount of carried toner, the types of sheet and environmental temperature, the control means 50 discontinues the image forming operation in the full-color mode temporarily and, as mentioned later, restarts the discontinued image forming operation at the time when the fusing roller temperature returns a full-color mode acceptable temperature. This ensures preventing imperfect fusing from occurring.

In the above-mentioned configuration, a fusing property test when continuously printing 999 sheets in the (1) single-color mode and (2) full-color mode was conducted.

(1) Single-Color Mode: Continuous Printing of 999 Sheets (Conditions) Paper: plain paper 80 g, size: A4

(2) Full-Color Mode: Continuous Printing of 999 Sheets (Conditions) Paper: plain paper 80 g, size: A4

Figure 14:
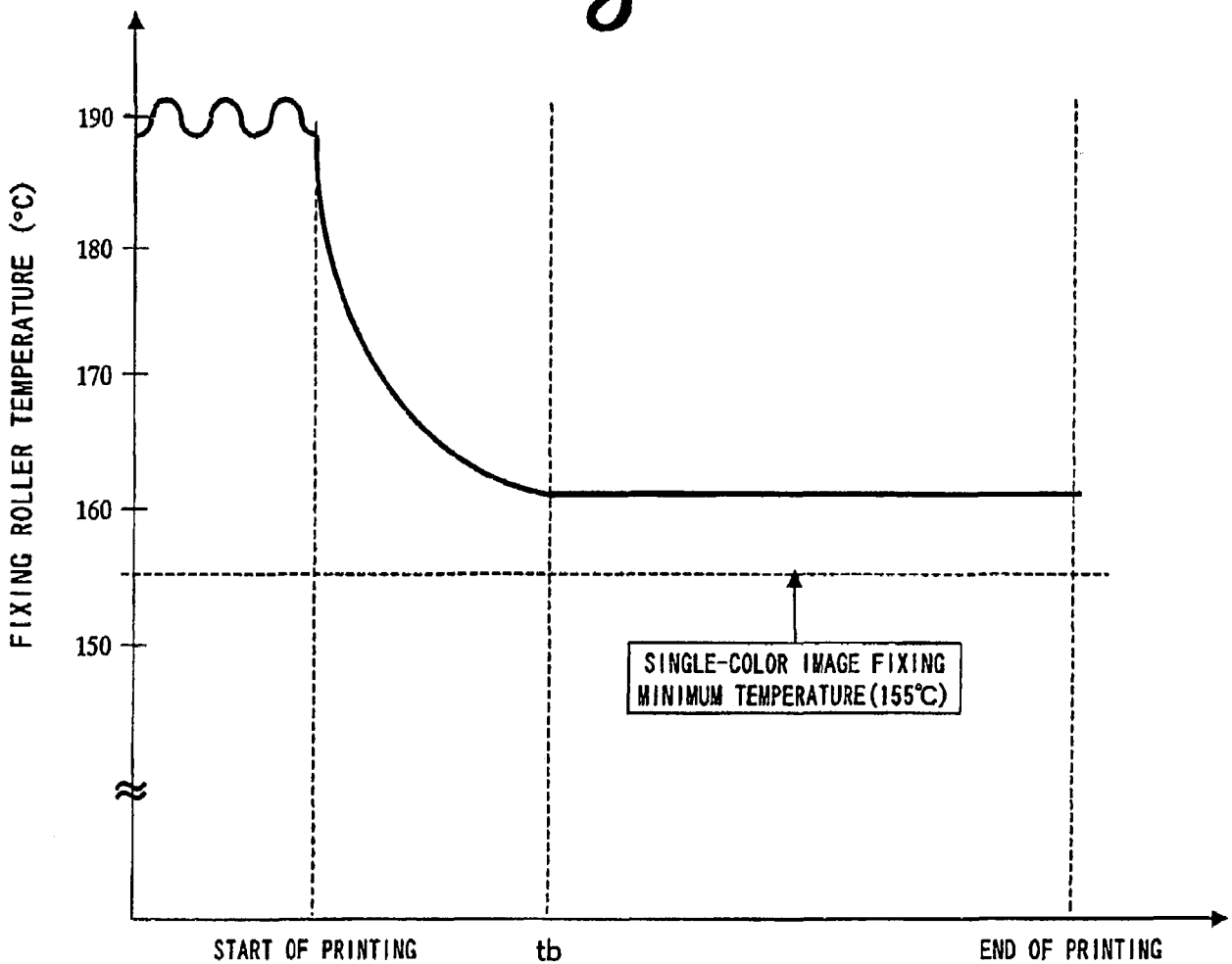
FIG. 14 is a graph showing shift in temperature of the fusing roller in the single-color mode of the fusing device in accordance with the fifth embodiment of the present invention.

FIG. 14 shows shift in temperature of the fusing roller 1 in the case of continuous printing of 999 sheets in the single-color mode. The fusing roller temperature is 190° C. at the start of image formation in the single-color mode (ta) and gradually lowers down to about 160° C. until the number of prints reaches about 200 (tb). Since then, the fusing roller temperature is kept to be 160° C. when the number of prints reaches 999.

As described above, for the fusing property in the single-color mode, since the image can be fixed as long as the fusing roller temperature is 155° C. even when the amount of carried toner is maximum, all of 999 sheets continuously printed in the single-color mode can obtain an excellent fusing property.

Figure 15:
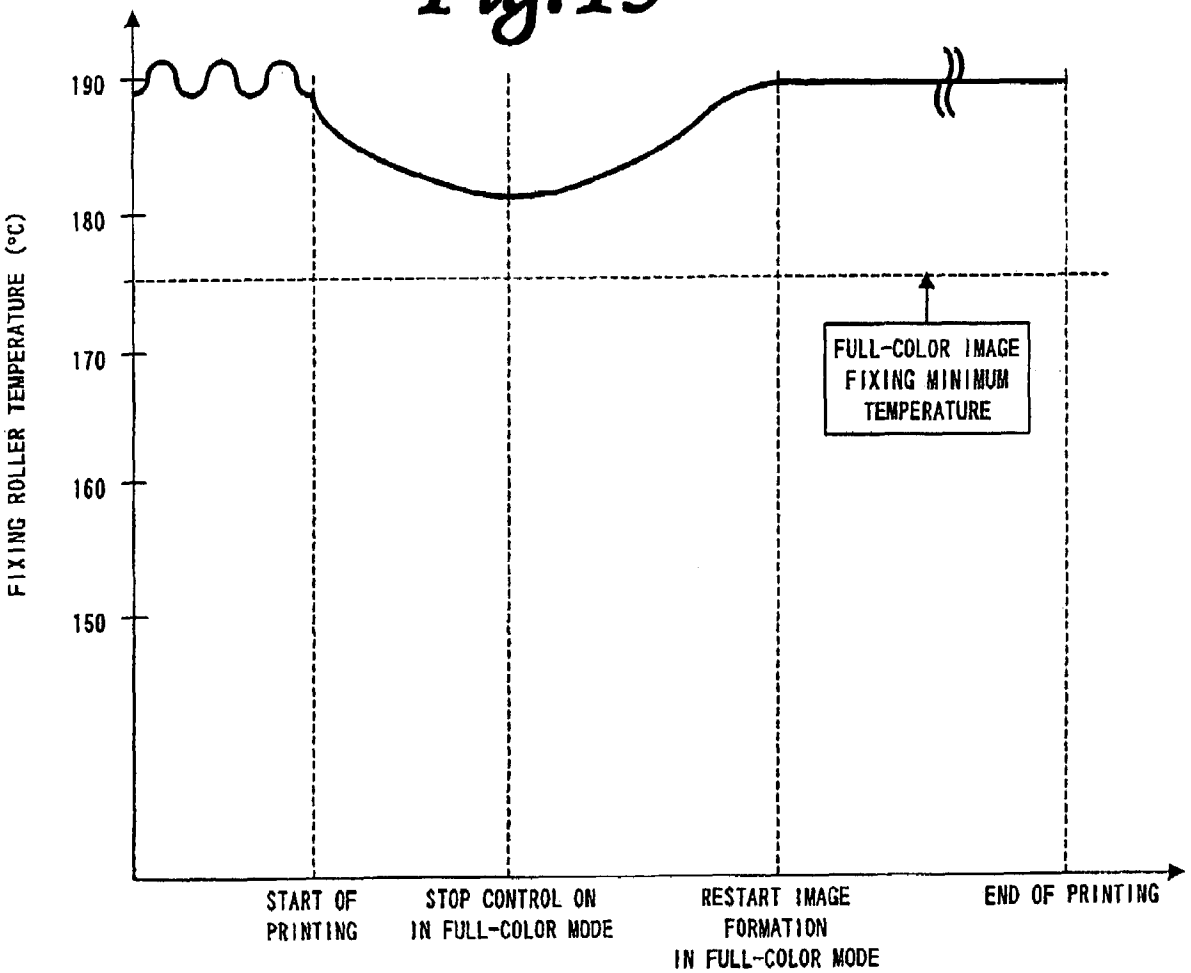
FIG. 15 is a graph showing shift in temperature of the fusing roller in the full-color mode of the fusing device in accordance with the fifth embodiment of the present invention.

FIG. 15 shows shift in temperature of the fusing roller 1 in the case of continuous printing of 999 sheets in the full-color mode. The fusing roller temperature is 190° C. at the start of image formation in the full-color mode (tc) and gradually lowers down to about 180° C. until the number of prints reaches about 20 (td). Subsequently, the fusing roller temperature rises and reaches 190° C. as the regulated fusing roller temperature when the number of prints reaches about 50 (te). Since then, the fusing roller temperature is kept to be 190° C. when the number of prints reaches 999.

As described above, for the fusing property in the full-color mode, since the image can be fixed as long as the fusing roller temperature is 175° C. even when the amount of carried toner is maximum, all of 999 sheets continuously printed in the full-color mode can obtain an excellent fusing property.

(Control Means)

Next, control characteristic of the present invention will be described. In the fifth embodiment, when printing in the full-color mode is started in succession to printing in the single-color mode, the fusing roller temperature is detected by the above-mentioned temperature detecting member.

As a result, when it is determined that the fusing roller temperature is lower than the predetermined full-color mode acceptable temperature by the temperature detecting member, image formation in the full-color mode is stopped prior to start by the control means 50 shown in FIG. 12.

Subsequently, during stop of the image formation in the full-color mode, the fusing roller 1 and the pressure roller 2 are heated and when the temperature detecting member determines that the fusing roller temperature reaches the full-color mode acceptable temperature, the full-color image formation is started.

Here, the full-color mode acceptable temperature is set at the lowest temperature of the fusing roller as a fusing member that is equal to or higher than the fusing minimum temperature at which the image formed in the full-color mode can be fixed (full-color mode fusing minimum temperature) when image formation (printing) in the full-color mode is continuously performed.

In other words, as long as the fusing roller temperature is equal to or higher than the full-color mode acceptable temperature at the start of color image formation, even when continuous printing in the full-color mode is performed immediately after that, the fusing roller temperature is maintained to be at least the full-color mode acceptable temperature. For that reason, all images continuously printed whether in the single-color mode or the full-color mode can obtain an excellent fusing property and at the same time, the operation of image formation can be prevented from stopping during continuous image formation.

In the fifth embodiment, the full-color mode acceptable temperature is set at 180° C. so that the fusing roller temperature reaches 190° C. when the color image reaches the fusing nipped part. That is, in the case where image is formed when the fusing roller temperature is the full-color mode acceptable temperature (180° C.), the fusing roller temperature reaches 190° C. when the recording material that holds toner thereon reaches the fusing nipped part after the above-mentioned image formation operation.

For this reason, as described in the case of (2) continuous printing of 999 sheets in the full-color mode, even when image formation in the full-color mode is continuously performed, the fusing property of the full-color image can be ensured without the fusing roller temperature falling below the full-color mode fusing minimum temperature. That is, the full-color mode acceptable temperature is set so as not to fall below the fusing minimum temperature even when continuous printing in the full-color mode is performed after the fusing roller temperature reaches the full-color mode acceptable temperature.

In the case where image formation in the full-color mode is started immediately after continuous image formation in the single-color mode, the image formed in the single-color mode may remain in the image forming apparatus without reaching the fusing nipped part. In this case, the full-color mode acceptable temperature is previously set to be higher by the temperature fallen of the fusing roller due to the single-color image remaining in the image forming apparatus.

When the fusing roller temperature exceeds the full-color mode acceptable temperature at the start of image formation in the full-color mode following image formation in the single-color mode, color image formation is performed in sequence without being stopped. When the fusing roller temperature exceeds the full-color mode acceptable temperature, the fusing roller temperature reached at least 190° C. at the time when the color image reaches the fusing nipped part. Therefore, even when image formation in the full-color mode is continuously performed since then, the fusing property of the full-color image can be ensured.

For image formation in the single-color mode after continuous image formation in the full-color mode, since the single-color mode fusing minimum temperature is lower than the full-color mode fusing minimum temperature, single-color image formation can be started at any timing and the fusing property of the single-color image can be properly maintained.

By adopting the above-mentioned configuration, the fusing performance of the following cases: (3) continuous printing of 999 sheets in the full-color mode immediately after continuous printing of 999 sheets in the single-color mode and (4) continuous printing of 999 sheets in the full-color mode immediately after continuous printing of 10 sheets in the single-color mode is tested.

(3) Continuous Printing of 999 Sheets in the Full-Color Mode Immediately after Continuous Printing of 999 sheets in the Single-Color Mode (Conditions) Paper: plain paper 80 g, size: A4

Figure 16:
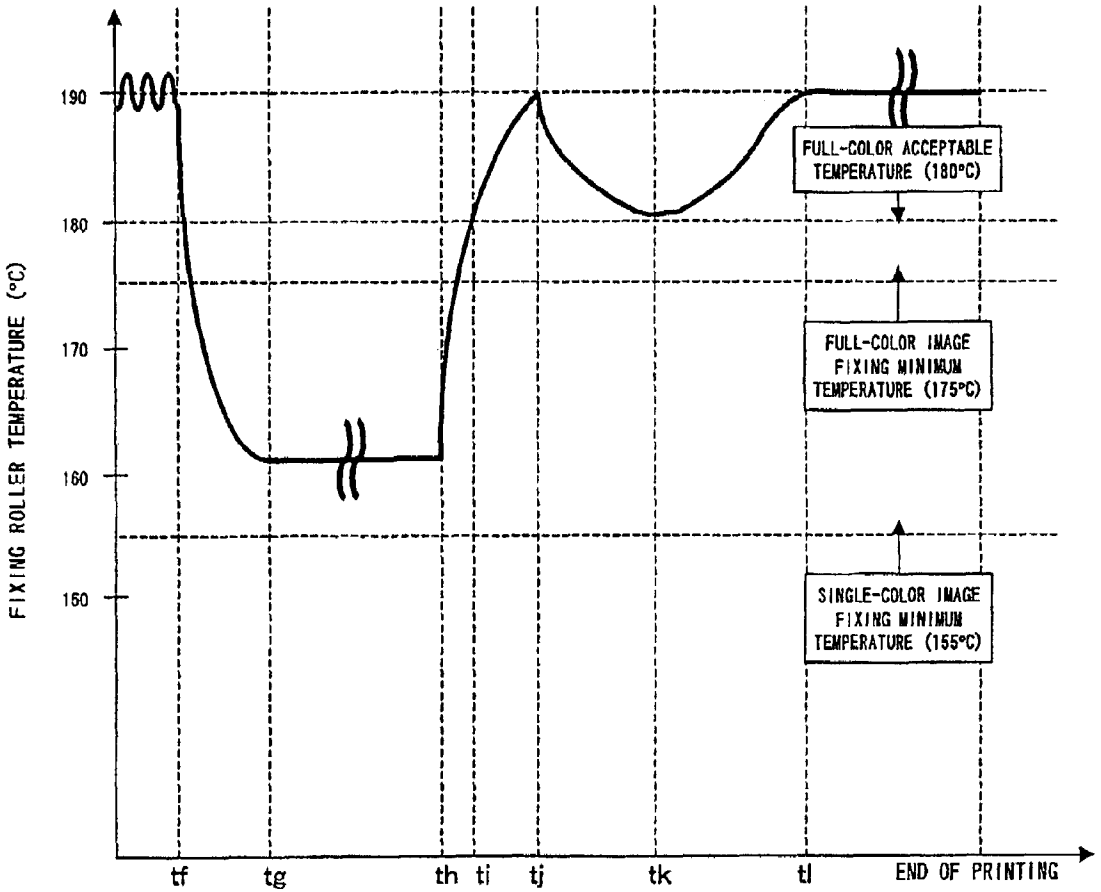
FIG. 16 is a graph showing shift in temperature of the fusing roller when using the single color mode and the full-color mode of the fusing device together in accordance with the fifth embodiment of the present invention.

Firstly, shift in temperature of the fusing roller temperature at the continuous printing of 999 sheets in the single-color mode will be described. FIG. 16 shows shift in temperature of the fusing roller temperature at continuous printing of 999 sheets in the full-color mode immediately after continuous printing of 999 sheets in the single-color mode.

As described above, the fusing roller temperature is 190° C. at the start of the single-color mode (tf). The fusing roller temperature lowers from 190° C. at the start of image formation to about 160° C. until the number of prints reaches 200 (tg). Subsequently, the fusing roller temperature is kept to be 160° C. when the number of prints reaches 999.

As described above, for the fusing property of the single-color image in the single-color mode, since the image can be fixed as long as the fusing roller temperature is 155° C. or more even when the amount of carried toner is maximum, all of 999 sheets continuously printed in the single-color mode can obtain an excellent fusing property.

The fusing roller temperature at the start of image formation in the full-color mode (th) after-completing image formation of 999 sheets in the single-color mode is 160° C. and therefore falls below the full-color mode acceptable temperature of 180° C. in the fifth embodiment. For this reason, the control means 50 stops the operation of image formation in the full-color mode prior to start.

At the time when the fusing roller temperature returns to 180° C. higher than the full-color mode fusing minimum temperature of 175° C. (ti), the above-mentioned process: charging—exposure—development—transfer is carried out and the fusing roller temperature reaches 190° C. when the recording material to which the toner image is transferred reaches the fusing roller (tj).

In the case where image formation in the full-color mode is continuously performed since then, as described in the case (2), the fusing roller temperature gradually lowers from 190° C. to about 180° C. until the number of prints reaches about 20 (tk). Subsequently, the fusing roller temperature rises and becomes stable at 190° C. as the regulated fusing roller temperature since the number of prints reaches about 50 (tl).

As described above, for the fusing property in the full-color mode, since the image can be fixed as long as the fusing roller temperature is 175° C. or more even when the amount of carried toner is maximum, all of 999 sheets continuously printed in the full-color mode can obtain an excellent fusing property.

(4) Continuous Printing of 999 Sheets in the Full-Color Mode Immediately after Continuous Printing of 10 Sheets in the Single-Color Mode (Conditions) Paper: plain paper 80 g, size: A4

Figure 17:
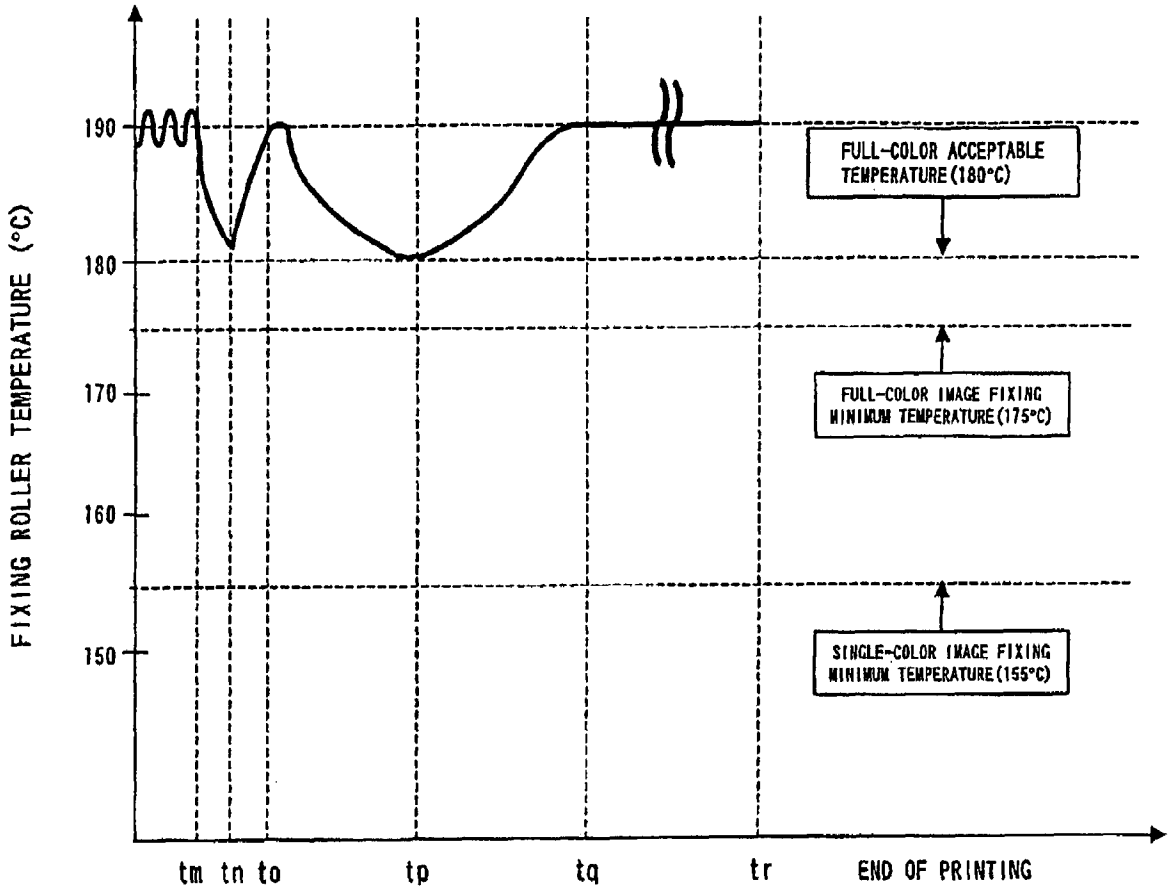
FIG. 17 is a graph showing shift in temperature of the fusing roller when using the single color mode and the full-color mode of the fusing device together in accordance with the fifth embodiment of the present invention.

FIG. 17 shows shift in temperature of the fusing roller temperature at continuous printing of 999 sheets in the full-color mode immediately after continuous printing of 10 sheets in the single-color mode. Firstly, shift in temperature of the fusing roller at continuous printing of 10 sheets in the single-color mode will be described.

The fusing roller temperature is 190° C. at the start of the single-color mode (tm). The fusing roller temperature lowers from 190° C. at the start of image formation to about 182° C. until the number of prints reaches 10 (tn). As described above, for the fusing property of the single-color image in the single-color mode, since the image can be fixed as long as the fusing roller temperature is 155° C. or more even when the amount of carried toner is maximum, all of 10 sheets of the single-color image can obtain an excellent fusing property.

The fusing roller temperature at the start of image formation in the full-color mode (to) after completing continuous printing of 10 sheets in the single-color mode is 182° C. and therefore exceeds the full-color mode acceptable temperature in the fifth embodiment of 180° C. Accordingly, the control means 50 starts the operation of image formation in the full-color mode without stopping it.

When the fusing roller temperature is equal to or higher than the full-color mode acceptable temperature of 180° C. at least at the start of image formation in the full-color mode, the following process: charging—exposure—development—transfer is carried out. When the recording material to which the toner image is transferred reaches the fusing roller (tp), the fusing roller temperature reaches 190° C. Therefore, in the case where image formation in the full-color mode is continuously performed since then, as described in the case (2), the fusing roller temperature gradually lowers from 190° C. to about 180° C. until the number of prints reaches about 20 (tq). Subsequently, the fusing roller temperature rises and becomes stable at 190° C. as the regulated fusing roller temperature since the number of prints reaches about 50 (tr).

As described above, for the fusing property in the full-color mode, since the image can be fixed as long as the fusing roller temperature is 175° C. or more even when the amount of carried toner is maximum, all of 999 sheets continuously printed in the full-color mode can obtain an excellent fusing property.

As has been described above, in the full-color image forming apparatus in which at least the productivity in the single-color mode is greater than that in the full-color mode, in the case where the fusing roller temperature at the start of full-color image formation is lower than the predetermined full-color mode acceptable temperature, even when full-color image formation in the full-color mode is intended to perform in succession to single-color image formation in the single-color mode, the control means 150 controls so that image formation in the full-color mode is stopped prior to start, and when the above-mentioned fusing roller temperature rises and reaches the above-mentioned full-color mode acceptable temperature, image formation in the full-color mode is started. As a result, the full-color image as well as the single-color image can obtain an excellent fusing property.

Further, since the fusing roller temperature does not fall below the full-color mode fusing minimum temperature during continuous image formation of the full-color image, the operation of image formation is not stopped during continuous image formation and the user need not to conduct unnecessary check operation.

The above-mentioned configuration in accordance with the fifth embodiment can be also applied to a so-called four-drum color image forming apparatus having photosensitive drums for each color as shown in FIG. 1 in which an interval between each image formation in the single-color mode is shorter than that in the full-color mode, that is, the greater image productivity is set.

Specifically, in the full-color image forming apparatus in which at least the productivity in the single-color mode is greater than that in the full-color mode, in the case where the fusing roller temperature at the start of full-color image formation is lower than the predetermined full-color mode acceptable temperature, even when full-color image formation in the full-color mode is intended to perform in succession to single-color image formation in the single-color mode, the control means 150 controls so that image formation in the full-color mode is stopped prior to start, and when the above-mentioned fusing roller temperature rises and reaches the above-mentioned full-color mode acceptable temperature, image formation in the full-color mode is started. As a result, the full-color image as well as the single-color image can obtain an excellent fusing property.

Although the fifth embodiment takes the case of continuous printing job of the full-color image in the full-color mode after continuous printing job of the single-color image in the single-color mode as an example, it can be also applied the following apparatus.

For example during a single print job of reading out a plurality of originals in which the single-color image and the full-color image are mixed by an automatic original reading apparatus (ADF), automatically determining whether the original is a single-color one or a full-color one from the results read out in the image forming apparatus, and printing them, the fusing roller temperature is detected by the temperature detecting member when the single-color image switches to the full-color image, and when the control means 50 determines that the fusing roller temperature is lower than the predetermined full-color mode acceptable temperature, image formation in the full-color mode is stopped prior to start, and then when the control means 50 determines that the fusing roller temperature reaches the full-color mode acceptable temperature during stop of the image formation in the full-color mode, image formation in the full-color mode is started. In this manner, the same effect can be obtained.

As described above, according to the fifth embodiment, since image formation in the full-color mode is start when the fusing roller temperature reaches the full-color mode acceptable temperature higher than the full-color image fusing minimum temperature, the operation of image formation can be prevented from being stopped during the subsequent continuous printing the full-color image due to falling of the temperature of the fusing member.

Although the embodiments of the present invention has been described specifically, the present invention is not limited to the above-mentioned embodiments and various modification based on the technical concept of the present invention can be realized.

For example, figures mentioned in the above-mentioned embodiments are only examples and different figures may be used as necessary.

Although these embodiments take a copying machine for copying the original, they can be applied to other image forming apparatus such as printer. In this case, the original refers to "image" data transmitted from an external personal computer connected to the printer via a LAN cable.

In addition, for example, a circuit substrate for directly controlling the image forming operation based on a signal sent from the temperature detecting member or a CPU for converting the signal sent from the temperature detecting member into temperature data and controlling the image forming operation based on the temperature data can be preferably used as the control means in each embodiment.

This application claims priority from Japanese Patent Applications No. 2003-422639 filed Dec. 19, 2003, and No. 2004-305129 filed Oct. 20, 2004, which is hereby incorporated by reference, herein.

What is claimed is:

1. An image forming apparatus comprising:

an image forming means capable of forming a multi-color image on a recording material;

a fixing means for heat-fixing the image formed on the recording material;

a detecting means for detecting temperature of the fixing means; and a means for decreasing a number of fixing operation per unit time when the detected temperature of the fixing means drops to a reference temperature during image formation, wherein the reference temperature in a single-color mode is lower than that in a multi-color mode.

2. An image forming apparatus of claim 1, wherein the decreased number of fixing operation per unit time in the single-color mode is larger than that in the multi-color mode.

3. An image forming apparatus of claim 1, wherein a reference temperature in an automatic mode capable of forming the single-color image and the multi-color image on the recording material sequentially is set as the reference temperature in the multi-color mode.

4. An image forming apparatus of claim 1, wherein image formation is discontinued when the detected temperature of the fixing means is lower than the reference temperature.

5. An image forming apparatus comprising:

an image forming means capable of forming a multi-color image on a recording material;

a fixing means for heat-fixing the image formed on the recording material;

a detecting means for detecting temperature of the fixing means; and a means for discontinuing image formation when the detected temperature of the fixing means drops to the reference temperature during image formation, wherein the reference temperature in a single-color mode is lower than that in a multi-color mode.

6. An image forming apparatus of claim 5, wherein when performing the multi-color mode after the single-color mode, image formation is on standby until the detected temperature of the fixing means reaches a predetermined temperature higher than the reference temperature in the multi-color mode.

7. An image forming apparatus of claim 5 or 6, wherein the number of fixing operation per unit time in the single-color mode is larger than that in the multi-color mode.

8. An image forming apparatus of claim 5, wherein a reference temperature in an automatic mode capable of forming the single-color image and the multi-color image on the recording material sequentially is set as the reference temperature in the multi-color mode.

* * * * *